US009585803B2

(12) United States Patent
Niedens

(10) Patent No.: US 9,585,803 B2
(45) Date of Patent: Mar. 7, 2017

(54) INVERTIBLE DRINKING DEVICE AND METHOD

(71) Applicant: Jeffrey G. Niedens, Peoria, IL (US)

(72) Inventor: Jeffrey G. Niedens, Peoria, IL (US)

( * ) Notice: Subject to any disclaimer, the term of this patent is extended or adjusted under 35 U.S.C. 154(b) by 95 days.

(21) Appl. No.: 14/569,834

(22) Filed: Dec. 15, 2014

(65) Prior Publication Data

US 2015/0164254 A1 Jun. 18, 2015

Related U.S. Application Data

(60) Provisional application No. 61/917,683, filed on Dec. 18, 2013.

(51) Int. Cl.

| | |
|---|---|
| ***A47G 19/22*** | (2006.01) |
| ***A61G 7/05*** | (2006.01) |
| ***A45F 3/16*** | (2006.01) |

(52) U.S. Cl.

CPC ..... *A61G 7/05* (2013.01); *A45F 3/16* (2013.01); *A47G 19/2266* (2013.01); *A61G 2200/32* (2013.01)

(58) Field of Classification Search

CPC ..... A47G 19/2272; A47G 19/2266; A47G 19/22; A54F 3/16; A54F 3/18; B65D 5/74; B65D 5/741; B65D 25/40; B65D 25/42; B65D 25/46; B65D 25/465; B65D 25/50; B65D 47/06; B65D 47/065; B65D 47/066

See application file for complete search history.

(56) References Cited

U.S. PATENT DOCUMENTS

| | | | | |
|---|---|---|---|---|
| 8,191,727 | B2 * | 6/2012 | Davies | A47G 19/2266 215/387 |
| 2006/0037963 | A1 * | 2/2006 | Pillado | A47G 19/2272 220/714 |
| 2008/0302754 | A1 * | 12/2008 | Lewin | A47G 19/2266 215/229 |
| 2009/0120946 | A1 * | 5/2009 | Hung | B65D 47/305 220/707 |
| 2011/0315698 | A1 * | 12/2011 | Donaldson | A47G 19/2266 220/705 |
| 2012/0261375 | A1 * | 10/2012 | Loging | A47G 19/2272 215/11.4 |
| 2012/0312832 | A1 * | 12/2012 | Lane | B65D 47/066 220/833 |
| 2013/0240545 | A1 * | 9/2013 | O'Sullivan | A47G 19/2266 220/710 |
| 2014/0048511 | A1 * | 2/2014 | El-Saden | A45F 3/16 215/389 |

* cited by examiner

*Primary Examiner* — Anthony Stashick
*Assistant Examiner* — Robert Poon
(74) *Attorney, Agent, or Firm* — Robin S. Fahlberg

(57) ABSTRACT

An invertible drinking device, moveable between an upright position and an inverted position, and including a body including a fluid chamber, a lid removeably attachable to the body, at least one drinking spout with an output end, and a valve assembly moveable between a first position and a second position. The body and the lid at least in part define a first fluid flow path and a second fluid flow path. The first fluid flow path is open to fluid flow, from the fluid chamber to the output end of one of the at least one drinking spouts, when the valve assembly is in the first position. The second fluid flow path is open to fluid flow, from the fluid chamber to the output end of one of the at least one drinking spouts, when the valve assembly is in the second position.

20 Claims, 20 Drawing Sheets

INVERTIBLE DRINKING DEVICE AND METHOD

PRIORITY

This application claims priority to and incorporates by reference, U.S. Provisional Patent Application No. 61/917,683, entitled "Invertible Drinking Device and Method", and filed Dec. 18, 2013.

BACKGROUND OF THE INVENTION

The present invention generally relates to a drinking device and method that allows a user to drink fluid from the drinking device when the device is in either of an upright or an inverted position.

Sports bottles, and other drinking devices, are commonly vacuum or injection molded of a non-breakable plastic, or extruded from metal, and include a large fill opening and a screw on, or snap on cap for closing the opening. They include an open top or cap that includes a straw or squirt outlet feature that enables the liquid to be consumed by the user. The drinking device is provided with only one drinking spout and allows for drinking from the bottle only when the bottle is in an upright position.

When an individual is lying in their bed at their home, or lying in a hospital bed, they may have trouble maneuvering the traditional drinking device into a position where they can drink from it. As can be seen, there may be an ongoing need to for drinking devices allowing a user to drink from them in either an upright or inverted position.

SUMMARY OF THE INVENTION

In one aspect of the present invention, an invertible drinking device moveable between an upright position and an inverted position includes a body including a fluid chamber, a lid removeably attachable to the body, at least one drinking spout including an output end, and a valve assembly moveable between a first position and a second position. The body and the lid, at least in part, define a first fluid flow path and a second fluid flow path. The first fluid flow path is open to fluid flow, from the fluid chamber to the output end of one of the at least one drinking spouts, when the valve assembly is in the first position, and the drinking device is in the upright position. The second fluid flow path is open to fluid flow, from the fluid chamber to the output end of one of the at least one drinking spouts, when the valve assembly is in the second position, and the drinking device is in the inverted position.

In another aspect of the present invention, an invertible drinking device includes a body including a fluid chamber, a lid removeably attachable to the body, a drinking spout, a valve assembly, and tubing. The lid includes an upright fluid input fluidly connected to the fluid chamber, and an inverted fluid input fluidly connected to the fluid chamber. The drinking spout includes a spout housing and a spout output end for drinking fluid. The valve assembly includes the spout housing and a sliding valve member including an upright fluid path closing edge and an inverted fluid path closing edge. The tubing includes an upright tubing input portion selectively and fluidly connecting the spout output end and the upright fluid input; and an inverted tubing input portion selectively and fluidly connecting the spout output end and the inverted fluid input. The valve assembly is moveable to a first position and a second position. In the first position, the inverted fluid path closing edge blocks the inverted tubing input portion, fluidly disconnecting the spout output end and the inverted fluid input. In the second position the upright fluid path closing edge blocks the upright tubing input portion, fluidly disconnecting the spout output end and the upright fluid input.

In yet another aspect of the present invention, a method of drinking from an invertible drinking device includes positioning the drinking device in an upright position; moving a valve assembly to a first position to open a first fluid flow path between a fluid chamber and an output end of a drinking spout; and drinking fluid, flowing through the first fluid flow path, from the output end of the drinking spout. The method also includes positioning the drinking device in an inverted position; moving the valve assembly to a second position to open a second fluid flow path between the fluid chamber and the output end of the drinking spout; and drinking fluid, flowing through the second fluid flow path, from the output end of the drinking spout.

These and other features, aspects and advantages of the present invention will become better understood with reference to the following drawings, description and claims.

DETAILED DESCRIPTION OF THE INVENTION

Figure 1:
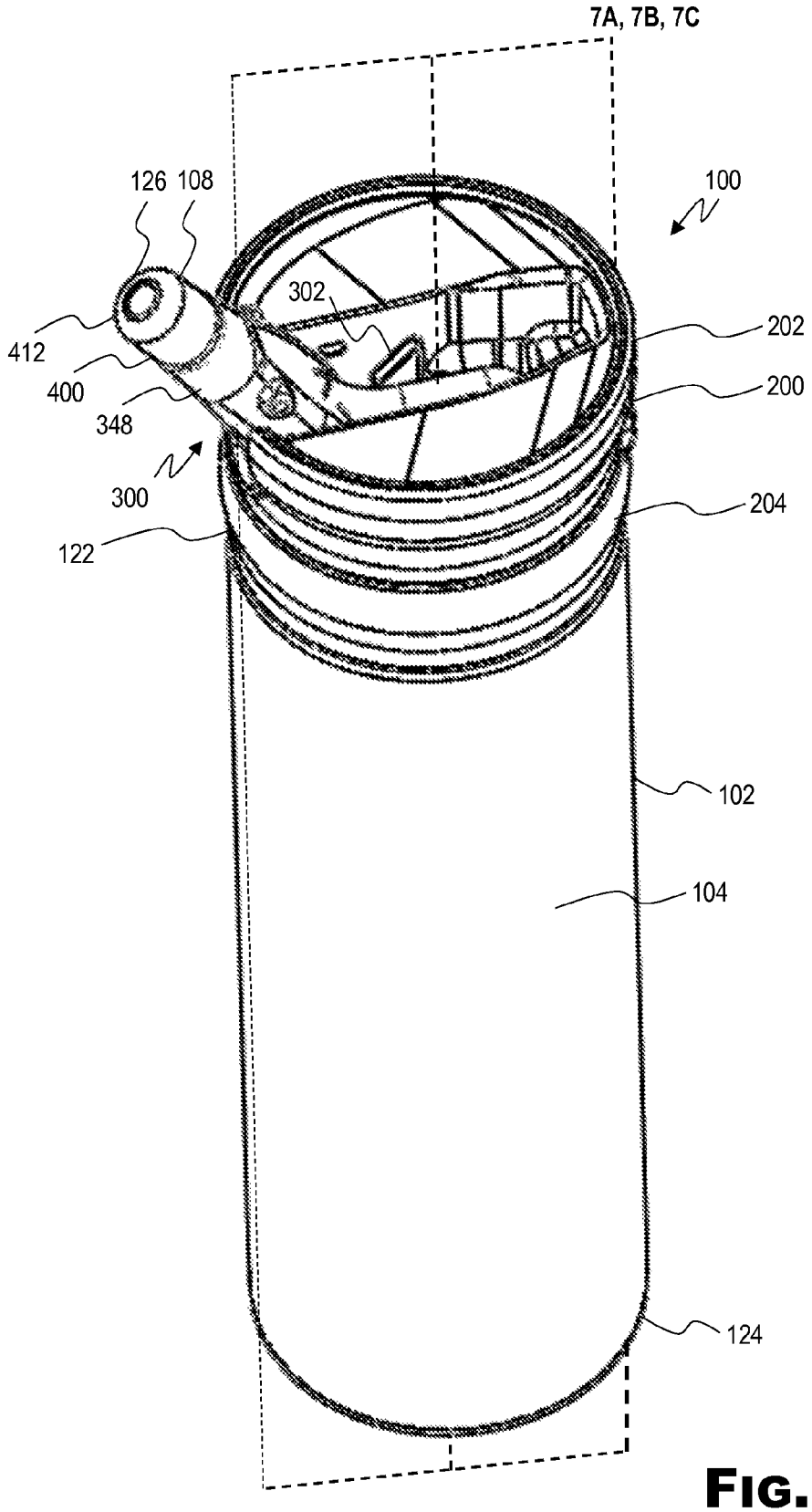
FIG. 1 is a perspective view of a drinking device according to an exemplary first embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above, or may only address one of the problems discussed above. Further, one or more of the problems discussed above may not be fully addressed by any of the features described below.

Embodiments of the present invention generally provide a drinking device that allows a user to drink fluid from the drinking device when the device is in either of an upright or an inverted position. Thus, a user can comfortably drink from the device when lying down. In prior art drinking devices, the user can drink from the upright drinking orientation only. Prior drinking bottles, for example, may include a large fill opening and a screw on or snap on cap for closing the opening, and have an open top or cap that includes a straw or squirt outlet feature that enables the liquid to be consumed by the user. The drinking bottle is provided with only one drinking spout and allows for drinking from the bottle only when the bottle is in an upright position. In contrast, embodiments of the present invention may allow for drinking from the inverted drinking position to enable the user to fill up the drinking device, attach the lid, invert the device, and sit the device on its "lid." The user may then retract a foldable spout, position the spout in the upside down drinking position, then drink comfortably from the bottom of the drinking device with minimal effort on the part of the user.

The user may have the present invention sitting beside them on their nightstand every night enabling them to have a reusable, functional means to consume liquids from a lying-down position. Embodiments of the invention may provide them a spill-proof means of consumption with minimal ambidextrous arm movement and with minimal suction needed to enable fluid to flow into the mouth of the user. This may provide ease of consumption to not only to an individual lying in their bed at their home, but also to individuals who are in hospital beds, individuals who have minimal means of movement, or individuals who are looking for consumption in multiple orientations. Embodiments of the present invention may allow those individuals to avoid raising their arm up over their head to quench their thirst, or to avoid raising their head to take a drink. Embodiments of the invention may allow the user to remain in the lying position, bring the drinking device to their mouth, and provide suction to begin the flow of fluids.

In one embodiment, an invertible drinking device may be moveable between an upright position and an inverted position. The drinking device may include a body including a fluid chamber, a lid removeably attachable to the body, at least one drinking spout including an output end, and a valve assembly moveable between a first position and a second position. The body and the lid may, at least in part, define a first fluid flow path and a second fluid flow path. The first fluid flow path may open to fluid flow, from the fluid chamber to the output end of one of the at least one drinking spouts, when the valve assembly is in the first position, and the drinking device is in the upright position. The second fluid flow path may open to fluid flow, from the fluid chamber to the output end of one of the at least one drinking spouts, when the valve assembly is in the second position, and the drinking device is in the inverted position.

In another embodiment, an invertible drinking device may include a body including a fluid chamber, a lid removeably attachable to the body, a drinking spout, a valve assembly, and tubing. The lid may include an upright fluid input fluidly connected to the fluid chamber, and an inverted fluid input fluidly connected to the fluid chamber. The drinking spout may include a spout housing and a spout output end for drinking fluid. The valve assembly may include the spout housing and a sliding valve member including an upright fluid path closing edge and an inverted fluid path closing edge. The tubing may include an upright tubing input portion selectively and fluidly connecting the spout output end and the upright fluid input; and an inverted tubing input portion selectively and fluidly connecting the spout output end and the inverted fluid input. The valve assembly may be moveable to a first position and a second position. In the first position, the inverted fluid path closing edge may block the inverted tubing input portion, fluidly disconnecting the spout output end and the inverted fluid input. In the second position the upright fluid path closing edge may block the upright tubing input portion, fluidly disconnecting the spout output end and the upright fluid input.

Figure 2A:
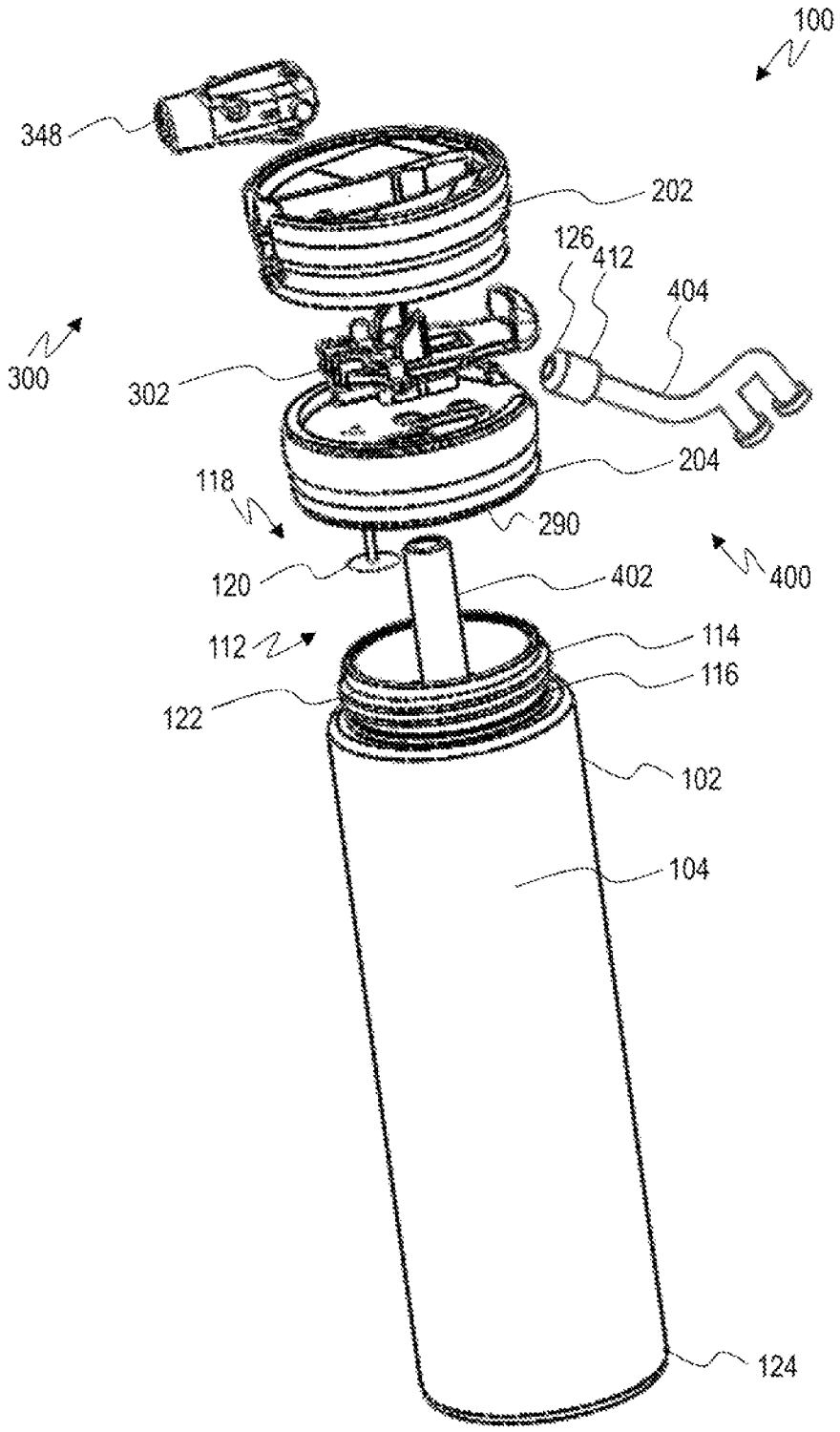
FIG. 2A is a perspective, expanded view of the drinking device of FIG. 1.
Figure 2B:
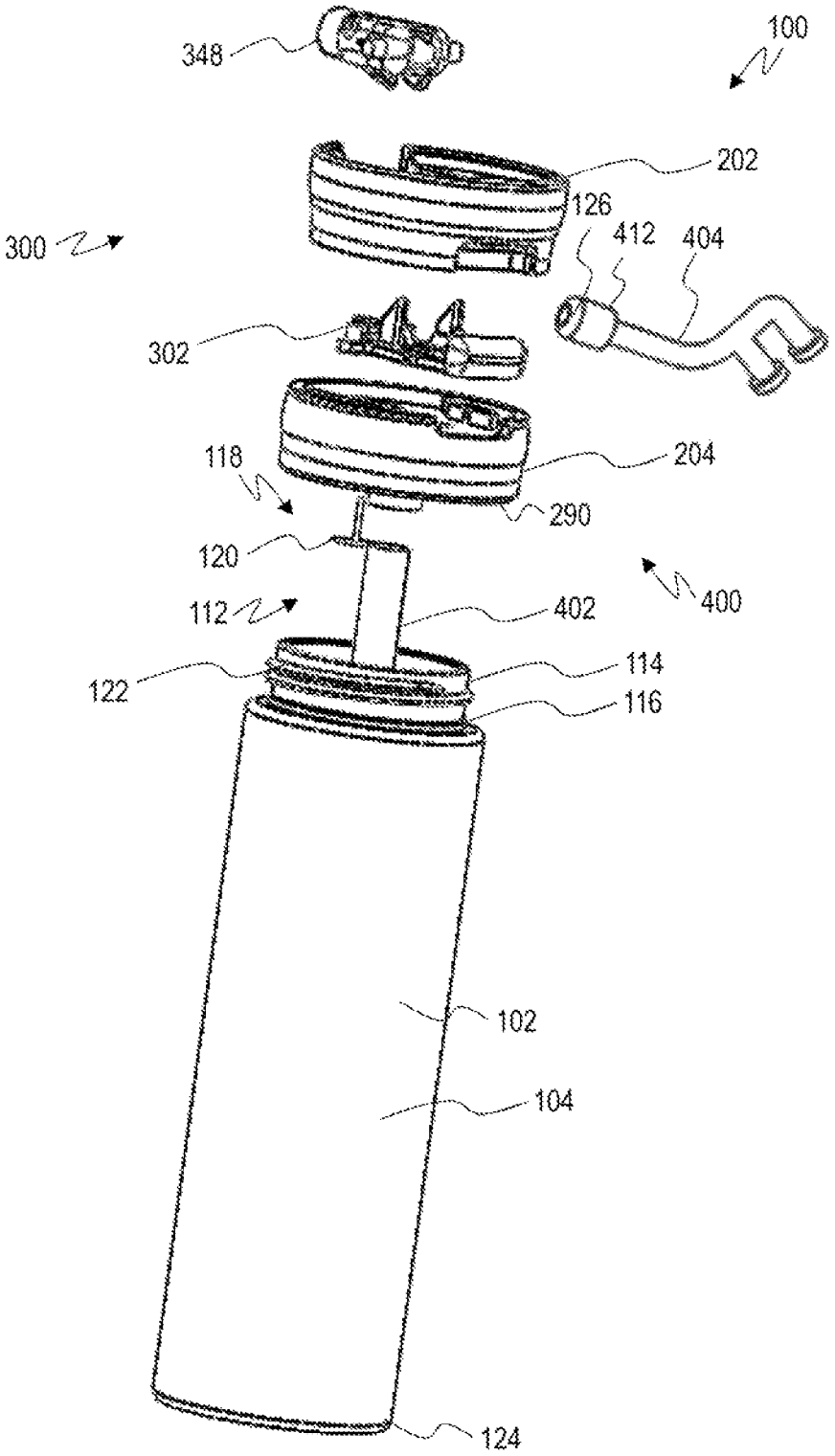
FIG. 2B is another perspective, expanded view of the drinking device of FIG. 1.

Referring now to FIGS. 1, 2A, and 2B, a perspective view, and two perspective expanded views of a first embodiment of an exemplary invertible drinking device 100 are illustrated. The drinking device 100 may include a body 102, a lid 200, a drinking spout 108, a valve assembly 300, and tubing 400. The valve assembly 300 may include a valve sliding member 302 and a spout housing 348. The tubing 400 may include a straw 402 and a tube assembly 404 with a nozzle 412. The body 102 may include an open end 122 and a closed end 124. The drinking spout may include the spout housing 348 and portions of the tube assembly 404.

The drinking device 100 may be configured such that a user may drink from the drinking spout 108 while the drinking device is in an upright position or an inverted position. For purposes of this application, an "upright position" is defined when the lid 200 is positioned upwards of the closed end 124, and the drinking device 100 is in a generally vertical position. In contrast, an "inverted position" is defined when the lid 200 is positioned downwards of the closed end, and the drinking device 100 is in a generally vertical position.

The body 102 may be generally cylindrically shaped and include a hollowed space forming a body chamber 104 for holding drinking fluid 106 (shown in FIGS. 7A, 7B, and 7C) therein. The body 102 may be made of metal, plastic, or another material rigid enough to hold the shape of the body 102 and impermeable to water or other drinking fluids which a person would seek to consume from the drinking device 100. The body 102 may be formed of an unbreakable material, such that it continues to hold fluid when dropped, or exposed to bumps, that would be usual in sports where a person would bring the drinking device 100, such as for example hiking or bicycling. In some embodiments, the body 102 may be made of a flexible material, for example a silicone, to allow for squeezing the bottle which may provide a better fluid flow through the drinking spout 108. In some embodiments, the body 102 may include and insulating material. Although generally cylindrical in form, a cross section of the body 102 need not be circular as illustrated. The cross section could, for example, be generally square, elliptical, triangular, or another shape.

An attachment device 112 including a first attachment device portion 114, and a second attachment device portion 290 (shown in FIG. 3D), may removeably attach the lid 200 to the body 102. In the illustrated embodiment, the attachment device 112 includes corresponding spiral grooves 116, 292 (shown in FIG. 3D) on the open end 122 and the lid 200 to allow the lid 200 to be screwed onto and off the body 102. In alternative embodiments, the attachment device 112 may include snap on devices or other attachment devices which would removeably attach the lid 200 to the body 102. The body 102 may include the first attachment device portion 114, which includes body spiral grooves 116 at the open end 122 in the embodiment illustrated. Although the open end 122 is illustrated as circular, which facilitates a spiral groove attachment device 112, the open end 122 could in other embodiments be shaped differently.

The lid 200 may be made of metal, plastic, or another material rigid enough to hold the shape of the lid 200, and impermeable to water or other drinking fluids. The lid 200 may be formed of an unbreakable material. In the embodiment illustrated, the lid 200 includes a lid top portion 202, and a lid bottom portion 204.

Figure 7A:
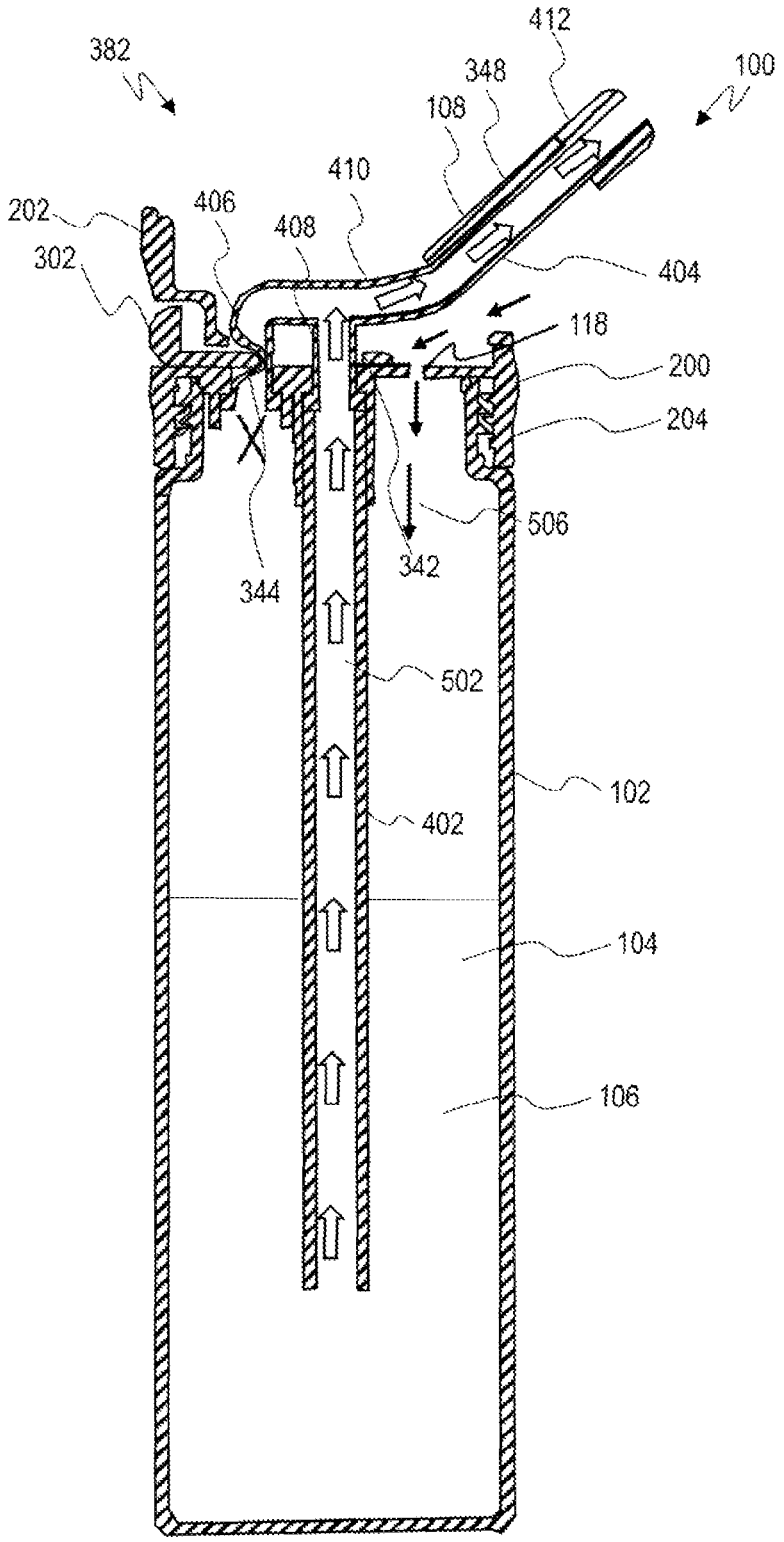
FIG. 7A is a sectional view of the drinking device of FIG. 1, with the valve assembly in a first valve position, along the sectional line 7A, 7B, 7C of FIG. 1 according to an exemplary embodiment of the invention.
Figure 7B:
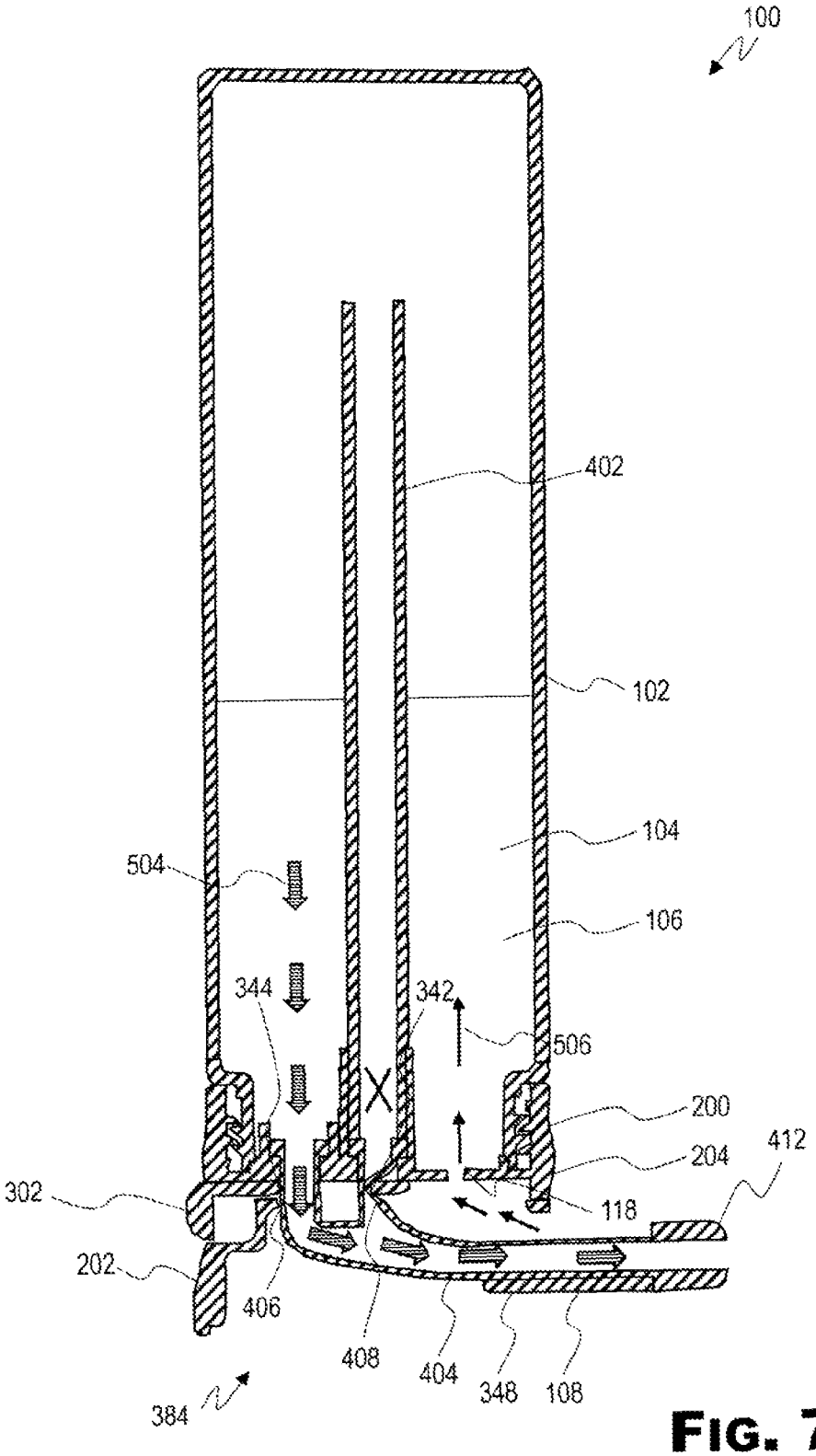
FIG. 7B is a sectional view of the drinking device of FIG. 1, with the valve assembly in a second valve position, along the sectional line 7A, 7B, 7C of FIG. 1 according to an exemplary embodiment of the invention.

The valve assembly 300 may be moveable to a first valve position 382 (shown in relation to FIG. 7A), and a second valve position 384 (shown in relation to FIG. 7B). The valve assembly 300 may also be moveable to a third valve position 386 (shown in relation to FIG. 7C).

Figure 3A:
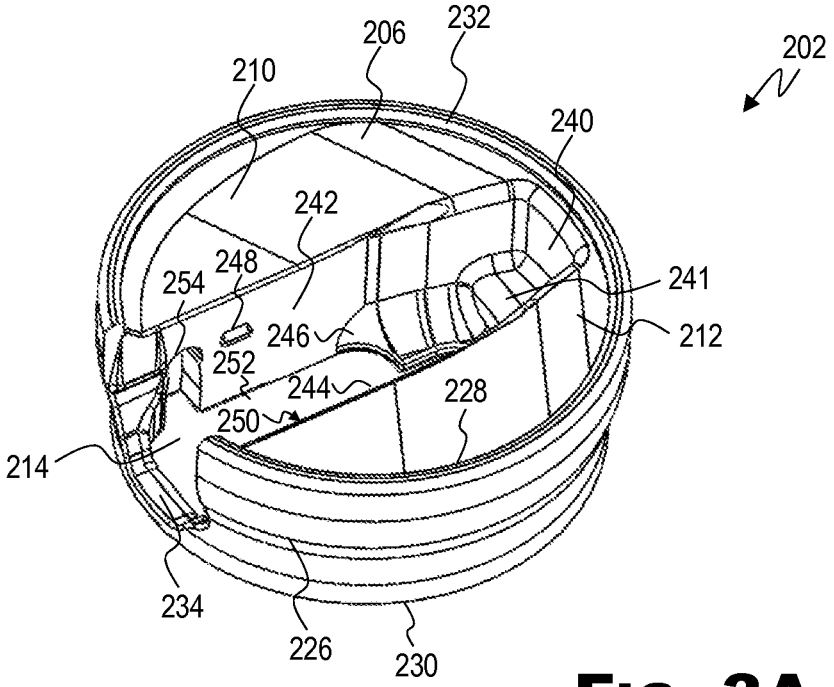
FIG. 3A is a top perspective view of a lid top portion according to an exemplary embodiment of the present invention.
Figure 3B:
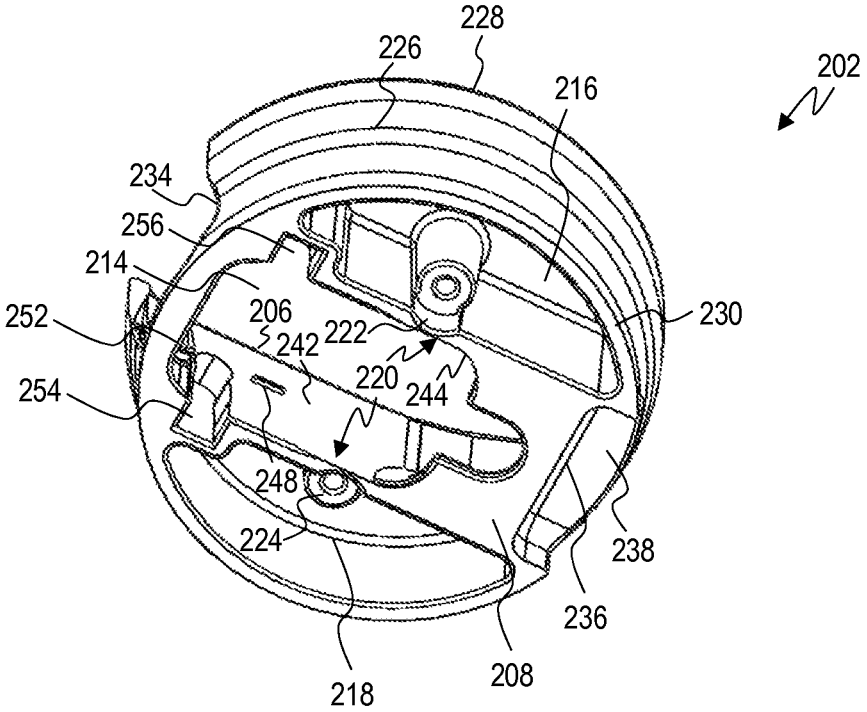
FIG. 3B is a bottom perspective view of the lid top portion of FIG. 3A.

Referring to FIGS. 3A and 3B, a top perspective view and a bottom perspective view of an exemplary lid top portion 202 are illustrated. The lid top portion 202 may include a top 206 and a bottom 208. A spout channel 214 may run between a first top portion 210 and a second top portion 212 on the top 206, and between a first hollow portion 216 and a second hollow portion 218 on the bottom 208. The first hollow portion 216 may be formed between the spout channel 214, the first top portion 210, and a side wall 226. The second hollow portion 218 may be formed between the spout channel 214, the second top portion 212, and the side wall 226. A first screw boss 222 may be positioned in the first hollow portion 216, adjacent the spout channel 214. A second screw boss 224 may be positioned in the second hollow portion 218, adjacent the spout channel 214. The first screw boss 222, and the second screw boss 224 may be parts of a lid portions connection device 220 for connecting the lid top portion 202, and the lid bottom portion 204.

The side wall 225 may include a side wall top 228, a side wall bottom 230, a side wall rim portion 232, a side wall channel cutaway 234, and a side wall indentation 236. The side wall indentation 236 may include a valve indentation top 238. The side wall rim portion 232 (which includes the side wall top 228) and the spout channel 214 may form the perimeter and define the first top portion 210 and the second top portion 212. The side wall rim portion 232 may begin on one side of the side wall channel cutaway 234, and end on the other side of the side wall channel cutaway 234.

The spout channel 214 may be configured such that the drinking spout 108 may lie flat in the spout channel 214. The spout channel 214 may include a channel back wall 240 with a spout seat 241, a channel first side wall 242, a channel second side wall 244, and a channel bottom wall 246. An opening to the spout channel 214, opposite the channel back wall 240 may be formed by the side wall channel cutaway 234. The spout seat 241 may be the opposite side of the valve indentation top 238. The channel first side wall 242 may include a first channel latch protrusion 248 and a first channel rotation indentation 254. The channel second side wall 244 may include a second channel latch protrusion 250 and a second channel rotation indentation 256. The second channel latch protrusion 250 and the second channel rotation indentation 256 may be mirror images of the first channel latch protrusion 248 and the first channel rotation indentation 254.

Figure 7C:
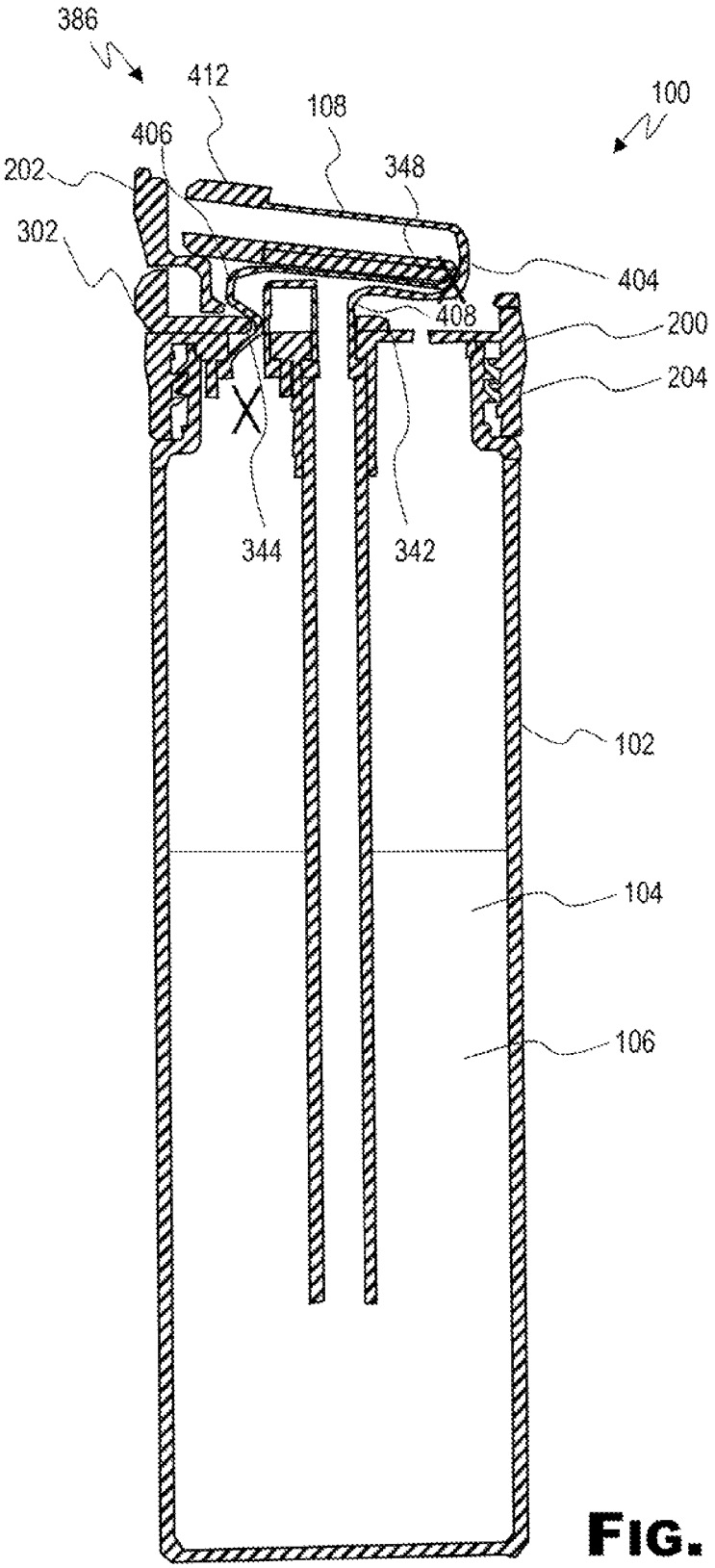
FIG. 7C is a sectional view of the drinking device of FIG. 1, with the valve assembly in a third valve position, along the sectional line 7A, 7B, 7C of FIG. 1 according to an exemplary embodiment of the invention.

The channel latch protrusions 242, 244 may interact with latch protrusions 370, 372 (shown in FIGS. 5A and 5B) on the spout housing 348 to latch the drinking spout 108 in a closed position (described in relation to FIG. 7C). The rotation indentations 254, 256 may interact with spout rotation protrusions 366, 368 (shown in FIGS. 5A and 5B) to rotably connect the spout housing 348 with the lid 200. The channel bottom wall 246 may include a channel aperture 252. Portions of the tube assembly 404 may run through the channel aperture to connect the body chamber 104 with the drinking spout 108.

Figure 3C:
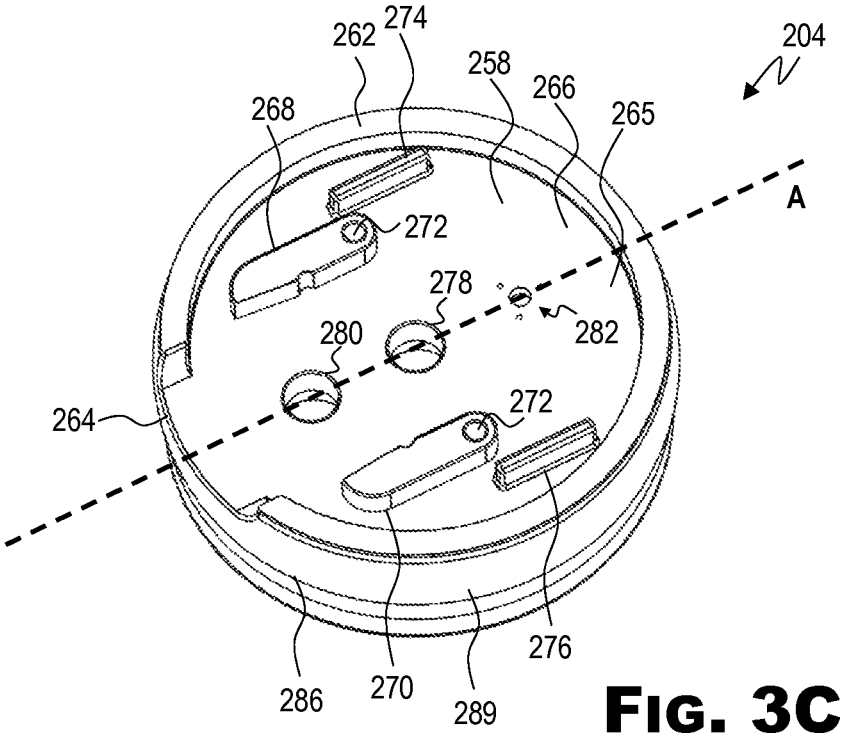
FIG. 3C is a top perspective view of a lid bottom portion according to an exemplary embodiment of the present invention.
Figure 3D:
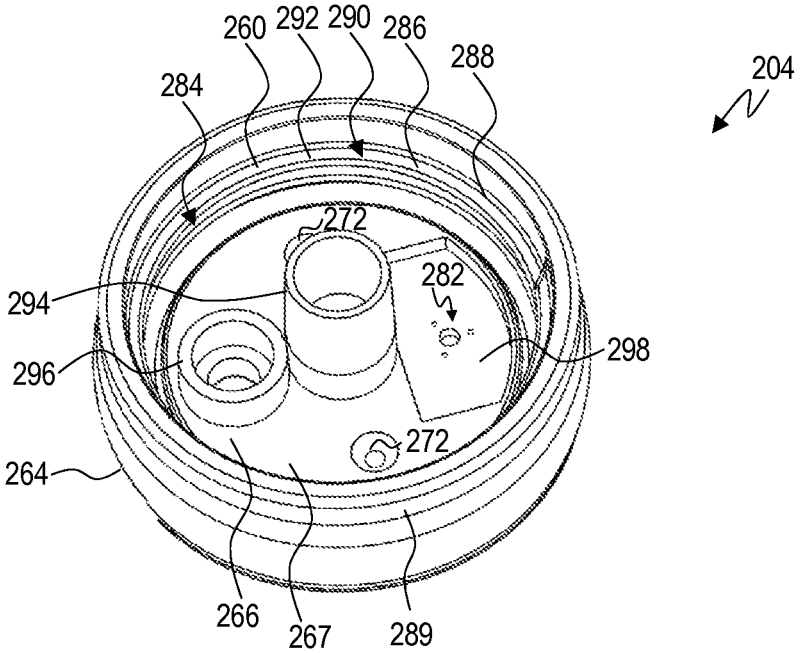
FIG. 3D is a bottom perspective view of the lid bottom portion of FIG. 3C.

Referring to FIGS. 3C and 3DB, a top perspective view and a bottom perspective view of an exemplary lid bottom portion 204 are illustrated. The lid top portion 202 may include a top 258, a bottom 260, a top wall 266, and a side wall 286. The top 258 may include the first side 265 of the top wall 258 surrounded by a rim 262 formed at the connection of the side wall 286 and the top wall 258. The rim 262 may include a valve cutout 264. When the top lid portion 202 and the bottom lid portion 204 are connected, the valve cutout 264 may line up with the side wall valve indentation (on the lid top portion 202) to form a space for an upright open push button 346 (shown in FIGS. 4A and 4B).

The bottom lid portion 204 may include a first valve guide 268, a second valve guide 270, a third valve guide 274, and a fourth valve guide 276. The first valve guide 268 may be fixedly connected to the first side 265, and may be an elongated flat member with two longer sides and two shorter sides, including a screw aperture 272. The second valve guide 270 may be fixedly connected to the first side 265, and may be an elongated flat member with two longer sides and two shorter sides, including a screw aperture. The second valve guide 270 may be a mirror image of the first valve guide 268, and may be fixed to the first side 265 in a mirror image to the first valve guide 268 in relation to a centerline A of the bottom lid portion 204. The screw apertures 272 may continue through the top wall 266. The screw apertures 272 may line up with the first screw boss, and the second screw boss of the lid top portion 202, such that screws may be inserted from the second side 267 and tightened to connect the lid top portion 202 and the lid bottom portion 204.

The third valve guide 274 may be fixedly connected to the first side 265, and may be an elongated flat member with two longer sides and two shorter sides. The third valve guide 274 may be positioned on the same side of the centerline A as the first valve guide 268, with one of the shorter sides of the first valve guide 268 forming an "L" like shape with one of the longer sides of the third valve guide 274. The third valve guide 274 may be positioned further from the centerline A than the first valve guide 268. The fourth valve guide 276 may be fixedly connected to the first side 265, and may be an elongated flat member with two longer sides and two shorter sides. The fourth valve guide 276 may be a mirror image of the third valve guide 274, and may be fixed to the first side 265 in a mirror image to the third valve guide 274 in relation to a centerline A. The fourth valve guide 276 may be positioned on the same side of the centerline A as the second valve guide 270, with one of the shorter sides of the second valve guide 270 forming an "L" like shape with one of the longer sides of the fourth valve guide 276. The fourth valve guide 276 may be positioned further from the centerline A than the second valve guide 270. The lid top portion 202 and the lid bottom portion 204 may be connected, sandwiching the valve sliding member 302 in between, such that the valve guides 268, 270, 274, 276, the channel first side wall 242, and channel second side wall 244 may guide the movement of the valve sliding member 302.

The top wall 266 may include an upright fluid aperture 278 and an inverted fluid aperture 280 which may be located along the centerline A. The upright fluid aperture 278 and the inverted fluid aperture 280 may align with an upright fluid input 294 and an inverted fluid input 296 affixed to the second side 267 of the top wall 266. The upright fluid input 294 and the inverted fluid input 296 may be generally cylindrical in shape, and may along with the upright fluid aperture 278 and the inverted fluid aperture 280 form conduits to house the tubing 400.

The top wall 266 may include vent apertures 282 which may allow air to flow into the body chamber 104 while a person is drinking fluid from the body chamber. The vent apertures 282 may extend through the top wall 266 to a vent indentation 298 on the second side 267. A check valve 120 may be positioned within the vent indentation 298 and vent apertures 282 to ensure that while air may flow into the body chamber 104 through the vent apertures 282, fluid may not flow out of the body chamber 104 through the vent apertures 282. Check valves with this function are well known in the art. The vent apertures 282 and check valve 120 may form one embodiment of a venting device 118. Other venting devices may alternatively be used.

The side wall 286 may define a hollow space 284 on the bottom 260 of the lid bottom portion 204. The upright fluid input 294, the inverted fluid input 296, and the vent indentation 298 may be located in the hollow space 284. The side wall 286 may include a first side 288 and a second side 289. The first side 288 may include the second attachment device portion 290, which may include lid spiral grooves 292.

Figure 4A:
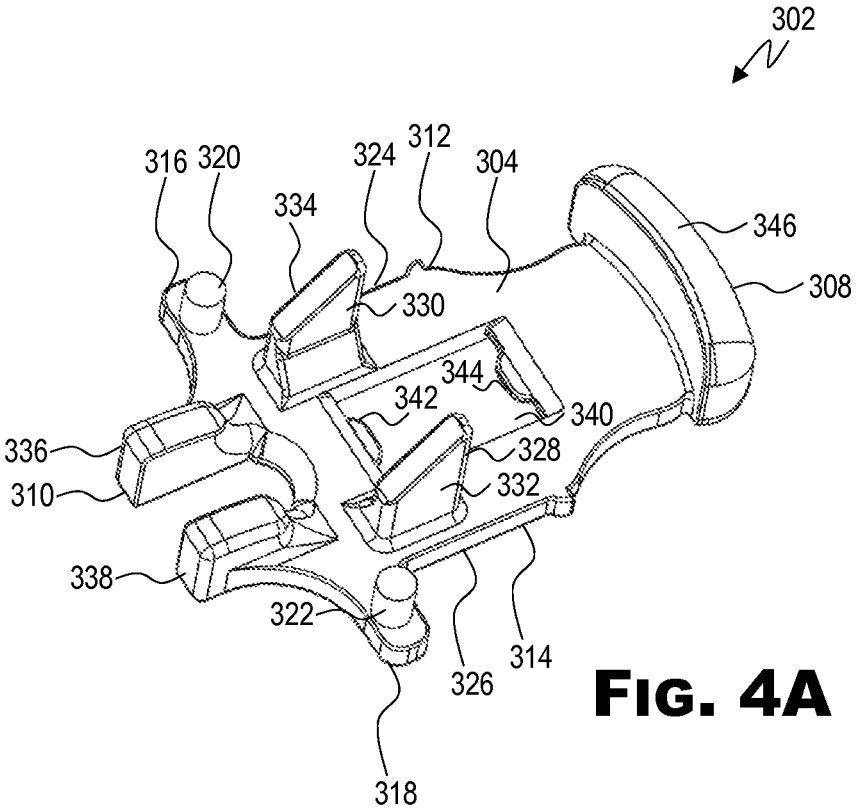
FIG. 4A is a top perspective view of a valve sliding member according to an exemplary embodiment of the present invention.
Figure 4B:
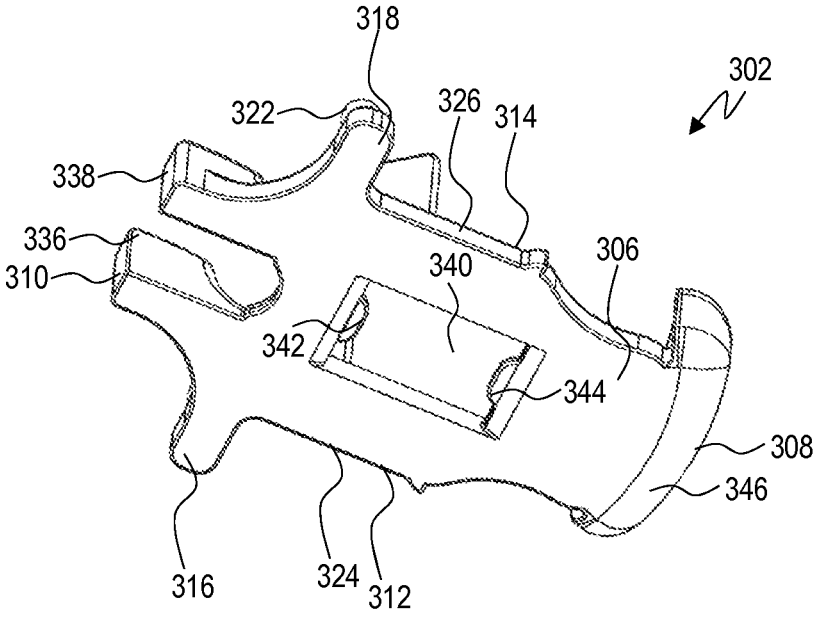
FIG. 4B is a bottom perspective view of the valve sliding member of FIG. 4A.

Referring now to FIGS. 4A and 4B, a top perspective view and a bottom perspective view of an exemplary valve sliding member 302 are illustrated. The valve sliding member 302 may include a top 304, a bottom 306, a first end 308, a second end 310, a first side 312, and a second side 314. The bottom 306 of the sliding valve member 302 may abut the top 258 of the bottom lid portion 204. The first side 312 may include a first guide portion 316 with a first guide protrusion 320 and a first guiding edge 324. As the valve assembly 300 moves between positions 382, 384, 386, the first guide portion 316 may slide along one of the longer sides of the third valve guide 274, while the first guide protrusion 320 slides along the channel first side wall 242. The first guiding edge 324 may slide along one of the longer sides of the first valve guide 268. The second side 314 may include a second guide portion 318 with a second guide protrusion 322 and a second guiding edge 326. As the valve assembly 300 moves between positions 382, 384, 386, the second guide portion 318 may slide along one of the longer sides of the fourth valve guide 276, while the second guide protrusion 322 slides along the channel second side wall 244. The second guiding edge 326 may slide along one of the longer sides of the second valve guide 270.

The sliding valve member 302 may include a first closed position protrusion 328 with a first guide surface 332, and a second closed position protrusion 330 with a second guide surface 334. As the valve assembly 300 moves between positions 382, 384, 386, the first guide surface 332 may slide along the channel first side wall 242, and the second guide surface 334 may slide along the channel second side wall 244. When a user pushes the drinking spout 108 inward towards the lid 200, and into the spout channel 214, a first spout closing protrusion 374 (shown in FIGS. 5A and 5B) on the spout housing 348 may interact with the first closed position protrusion 328; and a second spout closing protrusion 376 (shown in FIGS. 5A and 5B) on the spout housing 348 may interact with the second closed position protrusion 330, to slide the valve sliding member 302 into the third valve position 386.

The second end 310 of the sliding valve member 302 may include a first inverted position protrusion 336, and a second inverted position protrusion 338. When a user pushes the drinking spout 108 outwards away from the lid 200 for drinking while the drinking device 100 is in the inverted position, a first spout inverted protrusion 378 (shown in FIGS. 5A and 5B) on the spout housing 348 may interact with the first inverted position protrusion 336; and a second spout inverted protrusion 380 (shown in FIGS. 5A and 5B) on the spout housing 348 may interact with the second inverted position protrusion 338, to slide the valve sliding member 302 into the second valve position 384.

The sliding valve member 302 may include a fluid path aperture 340 with an upright fluid path closing edge 342, and an inverted fluid path closing edge 344. An upright input portion 408 (shown in FIG. 6) of the tube assembly 404 may extend from the upright fluid input 294 through the upright fluid aperture 278 and the fluid path aperture 340. An inverted input portion 406 (shown in FIG. 6) of the tube assembly 404 may extend from the inverted fluid input 296 through the inverted fluid aperture 280 and the fluid path aperture 340. When the vale assembly is in the first valve position 382, the inverted fluid path closing edge 344 may squeeze the tubing of the inverted input portion 406 as the inverted input portion 406 exits the inverted fluid aperture 280 to prevent fluid from flowing through the inverted input portion 406. When the vale assembly is in the second valve position 384, the upright fluid path closing edge 342 may squeeze the tubing of the upright input portion 408 as the upright input portion 408 exits the upright fluid aperture 278 to prevent fluid from flowing through the upright input portion 408.

The first end 308 of the valve sliding element 302 may include an upright open push button 346 which a user may push to automatically release the drinking spout 108 from a closed position where the drinking spout 108 is in the spout channel 214, to an upright drinking position (as shown in FIG. 1). The upright open push button 346 may be at least partially enclosed by the side wall valve indentation 236. When a user pushes the upright open push button 346, the first and second closed position protrusions 328, 330 push the first and second spout closing protrusions 374, 374 of the spout housing 348 unlatching the drinking spout 108 from the closed position.

Figure 5A:
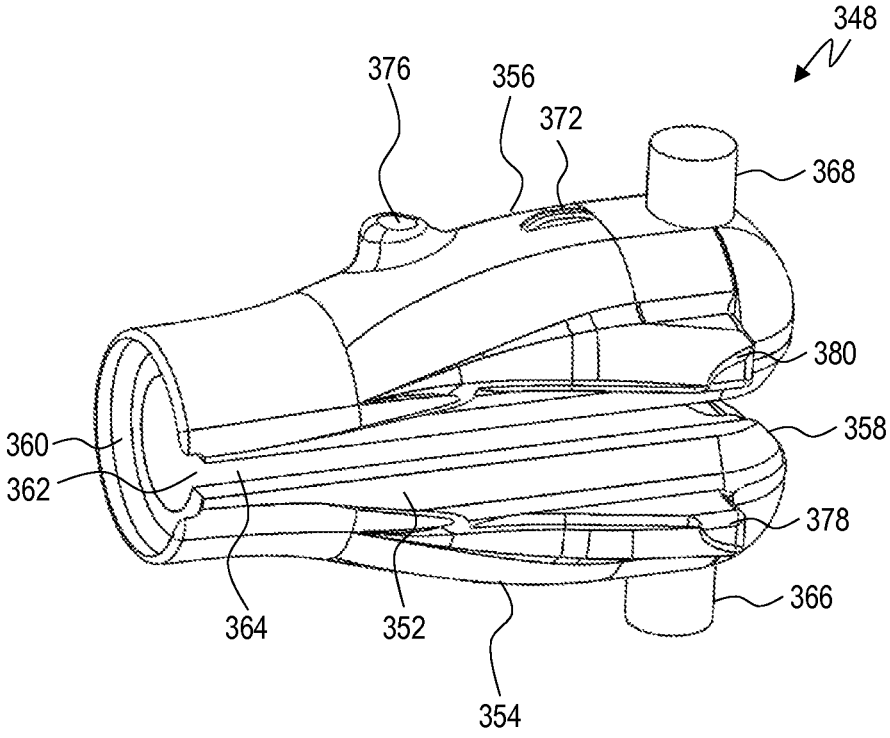
FIG. 5A is a top perspective view of a spout housing according to an exemplary embodiment of the present invention.
Figure 5B:
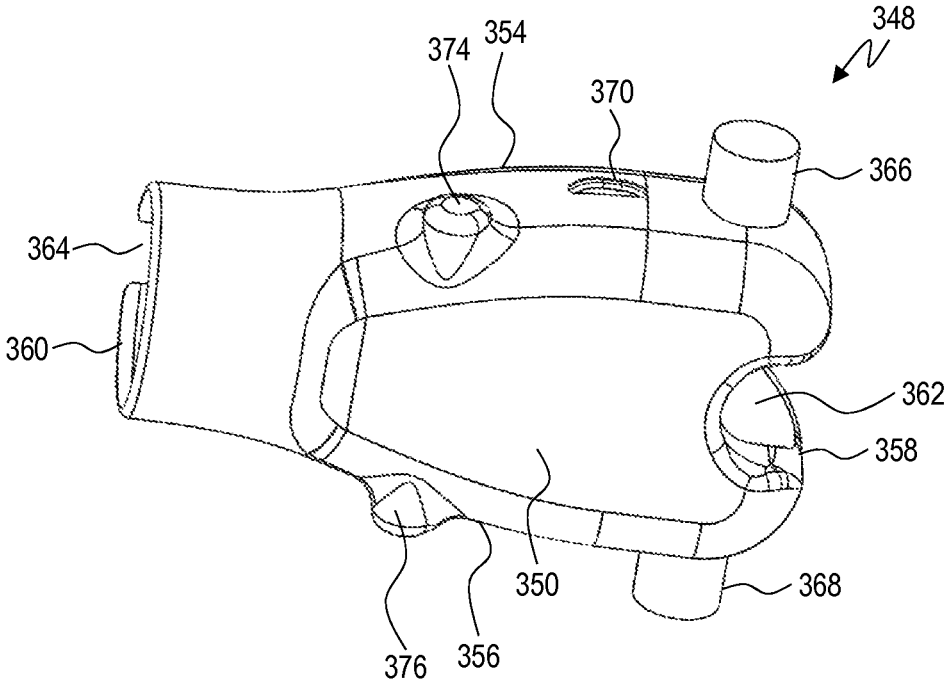
FIG. 5B is a bottom perspective view of the spout housing of FIG. 5A.

Referring now to FIGS. 5A and 5B, a top perspective view and a bottom perspective view of an exemplary spout housing 348 is illustrated. The spout housing 348 may include a spout housing top 350, a spout housing bottom 352, a spout housing first side 354, a spout housing second side 356, a spout housing input end 358, and a spout housing output end 360. A drinking tube channel 362 may run through the spout housing 348 from the spout housing input end 358 to the spout housing output end 360. Part of a main portion 410 (shown in FIG. 6) of the tube assembly may run through the drinking tube channel 362 such that the nozzle 412 abuts the spout housing output end 360. The drinking tube channel 362 may be generally cylindrical and may include a lengthwise slit 364. Part of the main portion 410 may be inserted into the drinking tube channel 362 through the slit 364 during assembly.

The spout housing first side 354 may include a first spout rotation protrusion 366 near the spout housing input end 358; and the spout housing second side 356 may include a second spout rotation protrusion 368 near the spout housing input end 358. The first spout rotation protrusion 366 may extend into the first channel rotation indentation 254, and the second spout rotation protrusion 368 may extend into the second channel rotation indentation 256; pivotally connecting the spout housing 348 to the lid 200.

The spout housing first side 354 may include a first spout latch protrusion 370; and the spout housing second side 356 may include a second spout latch protrusion 372. When a user pushes the drinking spout 108 inward towards the lid 200, and into the spout channel 214, the first spout latch protrusion 370 may interact with the first channel latch protrusion 248, and the second spout latch protrusion 372 may interact with the second channel latch protrusion 250, to latch the drinking spout 108 in a closed position.

The spout housing first side 354 may include the first spout closing protrusion 374; and the spout housing second side 356 may include the second spout closing protrusion 376. The spout housing input end 358 may include the first spout inverted protrusion 378 and the second spout inverted protrusion 380.

Figure 6:
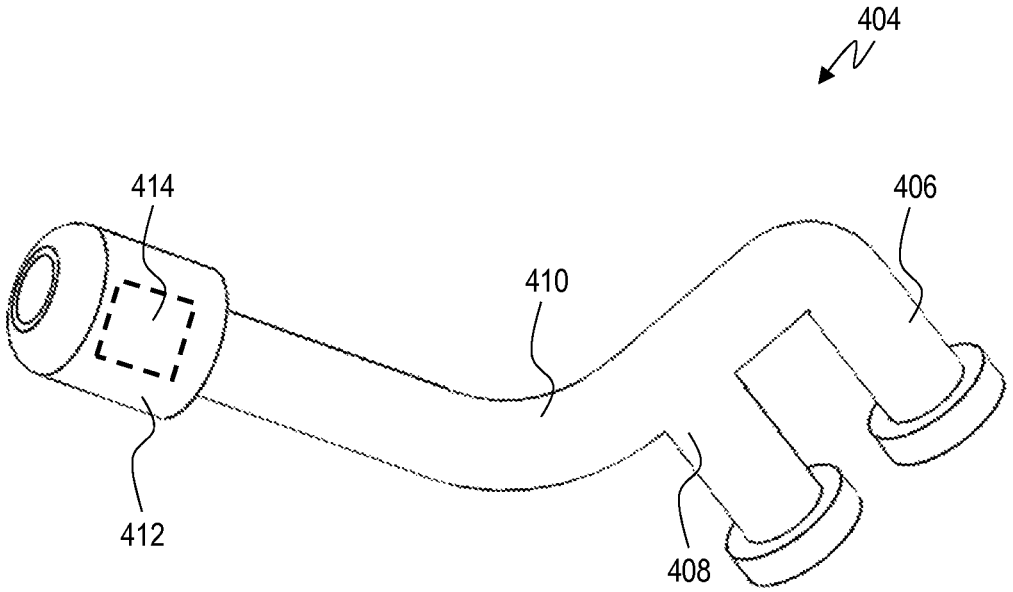
FIG. 6 is a perspective view of a tube assembly according to an exemplary embodiment of the invention.

Referring now to FIG. 6, a perspective view of an exemplary embodiment of the tube assembly 404 is illustrated. The tube assembly 404 may include the inverted input portion 406, the upright input portion 408, the main portion 410, the nozzle, and a spill valve 414. The inverted input portion 406 may be a tube joined to the main portion 410. The upright input portion 408 may be a tube joined to the main portion 410. The main portion 410 may be a tube joined to the nozzle 412 at one end, the inverted input portion 406 on the other end, and the upright input portion 408 between the two ends. A spill valve 414 may be located in the nozzle 412.

The inverted input portion 406 may extend from the inverted fluid input 296, through the inverted fluid aperture 280, through the fluid path aperture 340 and join the main portion 410. Fluid may flow through the inverted input portion 406, to the main portion 410, to the nozzle 412, and then out the drinking spout 108 when the drinking device 100 is in the inverted position, and the valve assembly 300 is in the second position 384. When the drinking device 100 is in the upright position, the inverted fluid input 296 is above the drinking fluid 106 level, and thus no fluid flows through the inverted fluid portion 406. When the valve assembly 300 is in the first valve position 382, the inverted fluid path closing edge 344 squeezes the inverted input portion 406 such that no fluid may flow through the inverted input portion 406.

The upright input portion 408 may extend from the upright fluid input 294, through the upright fluid aperture 278, through the fluid path aperture 340 and join the main portion 410. Fluid may flow through the straw 402, to the upright input portion 408, to the main portion 410, to the nozzle 412, and then out the drinking spout 108 when the drinking device 100 is in the upright position, and the valve assembly 300 is in the first position 382. When the drinking device 100 is in the inverted position, the end of, and fluid input to, the straw 402 is above the drinking fluid 106 level, and thus no fluid flows through the upright fluid portion 408. When the valve assembly 300 is in the second valve position 384, the upright fluid path closing edge 342 squeezes the upright input portion 408 such that no fluid may flow through the upright input portion 408.

The main portion 410 may extend from the inverted input portion 406 and the upright input portion 408, to and through the drinking tube channel 362, to the nozzle 412. When the drinking device 100 is in the upright position, and the valve assembly is in the first valve position 382, fluid may flow from the upright input portion 408, through the main portion 410, to the nozzle 412. When the drinking device 100 is in the inverted position, and the valve assembly is in the second valve position 384, fluid may flow from the inverted input portion 406, through the main portion 410, to the nozzle 412. When the valve assembly 300 is in the third valve position 386 (closed position), the position of the spout housing 348 stretches the main portion 410, such that the main portion 410 is squeezed together and blocked at entrance to the drinking tube channel 362 at the spout housing input end 358.

Referring now to FIG. 7A, a sectional view of the exemplary drinking device 100 of FIG. 1, with the valve assembly 300 in the first valve position 382, along the sectional line 7A, 7B, 7C of FIG. 1 is illustrated. In the illustration, the drinking device 100 may be in an upright position and the drinking spout 108 may be rotated to an outward position from the lid 200. Drinking fluid 106 from the body chamber 104 may follow a first fluid flow path 502 through the straw 402, through the upright fluid input 294, through the upright input portion 408, through the main portion 410, through the nozzle 412, and to the user. The first fluid flow path 502 is illustrated with the unfilled arrows. The user may use suction to draw the drinking fluid 106 out of the drinking device 100. The inverted input portion 406 may be blocked by the inverted fluid path closing edge 342 squeezing the inverted input portion 406, as illustrated with the "X". Air may enter the body chamber 104 through the venting device 118 following an air flow path 506. The air flow path is illustrated with the single line arrows.

Referring now to FIG. 7B, a sectional view of the exemplary drinking device 100 of FIG. 1, with the valve assembly 300 in the second valve position 384, along the sectional line 7A, 7B, 7C of FIG. 1 is illustrated. In the illustration, the drinking device 100 may be in an inverted position and the drinking spout 108 may be rotated to a fully outward position from the lid 200. Drinking fluid 106 from the body chamber 104 may follow a second fluid flow path 504 through the inverted fluid input 296, through the inverted input portion 406, through the main portion 410, through the nozzle 412, and to the user. The second fluid flow path 504 is illustrated with the stripe filled arrows. The user may use suction to draw the drinking fluid 106 out of the drinking device 100. The upright input portion 408 may be blocked by the upright fluid path closing edge 344 squeezing the upright input portion 408, as illustrated with the "X". The input end of the straw 402 may also be above the drinking fluid level 106, also preventing any drinking fluid 106 from following the first fluid flow path 502. Air may enter the body chamber 104 through the venting device 118 following an air flow path 506. The air flow path is illustrated with the single line arrows.

Referring now to FIG. 7C, a sectional view of the exemplary drinking device 100 of FIG. 1, with the valve assembly 300 in the third valve position 384, along the sectional line 7A, 7B, 7C of FIG. 1 is illustrated. In the illustration, the drinking device 100 is shown in an upright position, but could also be inverted. The drinking spout 108 may be rotated to an inward position where the drinking spout 108 rests in the spout channel 214, with the nozzle 412 resting on the spout seat 241. The third valve position 384 may be a closed position, where the drinking fluid 106 cannot follow either the first fluid flow path 502, or the second fluid flow path 504.

Figure 8A:
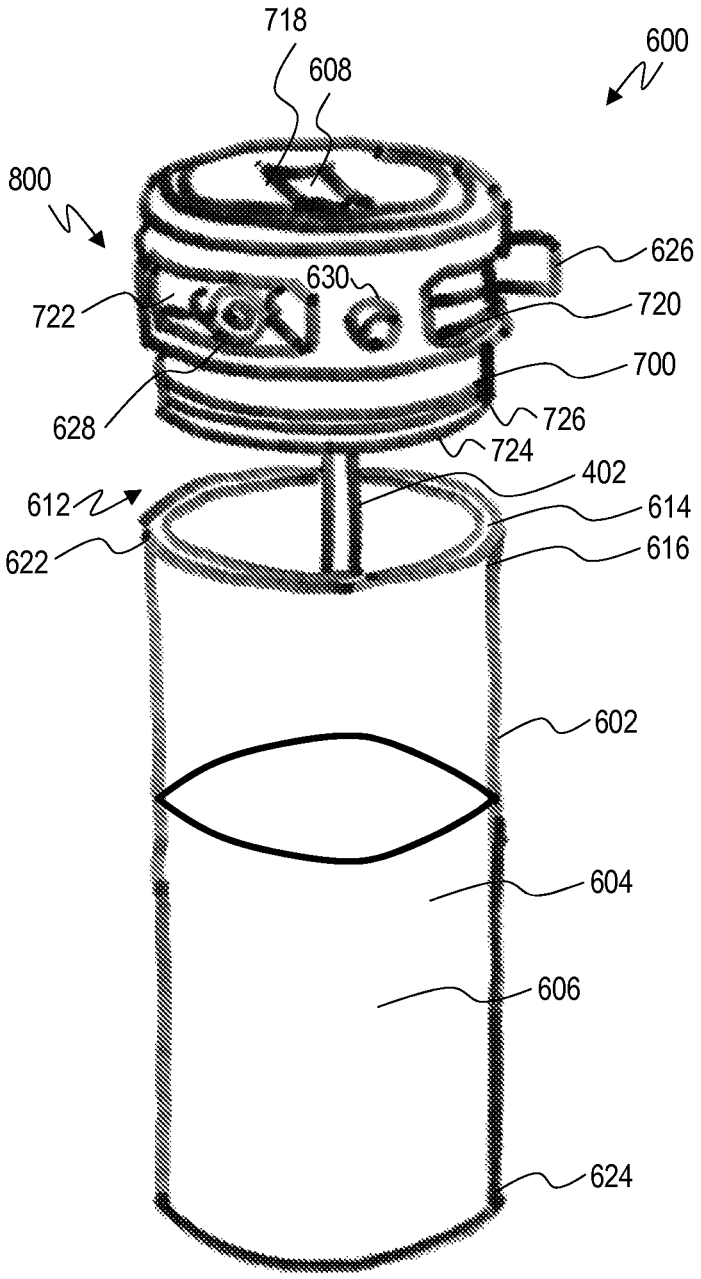
FIG. 8A is a perspective, expanded view of a drinking device according to an exemplary second embodiment of the present invention.
Figure 8B:
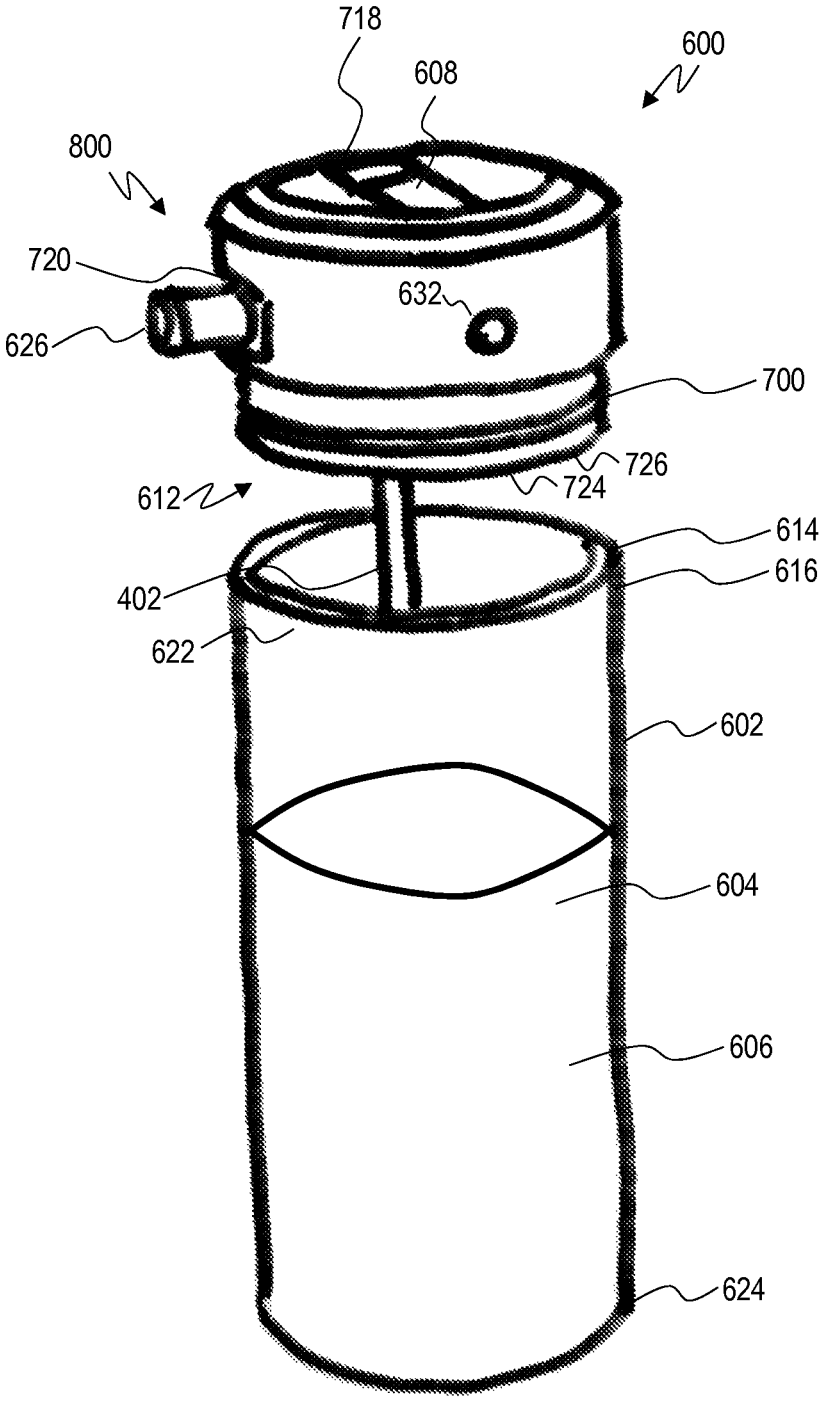
FIG. 8B is another perspective, expanded view of the drinking device of FIG. 8A.

Referring now to FIGS. 8A and 8B, two perspective, expanded views of an exemplary second embodiment of the drinking device 600 are illustrated. The drinking device 600 may be moveable between an upright position and an inverted position. The drinking device 600 may include a body 602 including a body chamber 604, a lid 700 removeably attachable to the body 602, a first spout 608 with a first spout output end 634, a second spout 626 with a second spout output end 642, and a third spout 628 with a third spout output end 648, and a valve assembly 800 moveable between a first valve position 834 (shown in FIG. 11A) and a second valve position 836 (shown in FIG. 11B). The valve assembly 800 may include a spool valve 802, the first spout 608, the second spout 626, and the third spout 628.

Figure 11A:
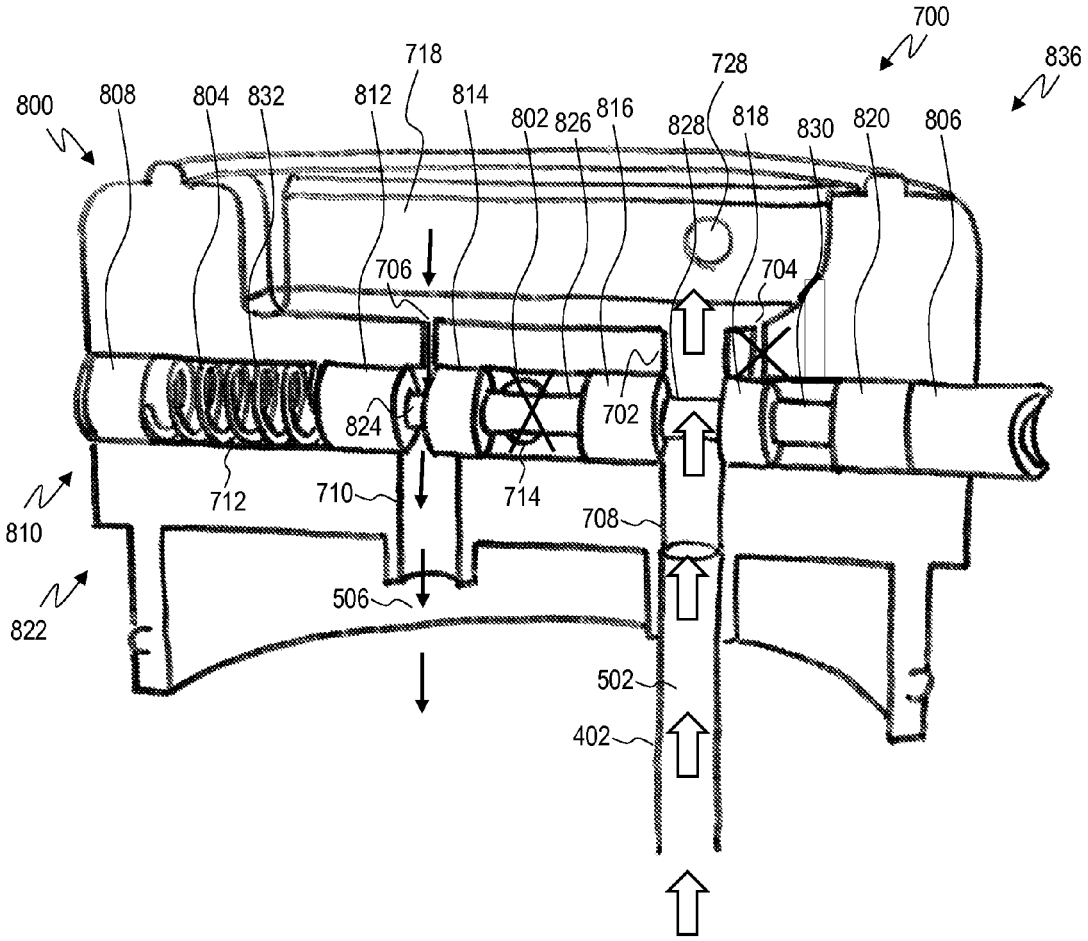
FIG. 11A is a cutaway view of the lid of FIG. 9A, with the valve assembly in a first valve position, along the cutaway line 11A, 11B of FIGS. 9A, 9B and 9C according to an exemplary embodiment of the invention.
Figure 11B:
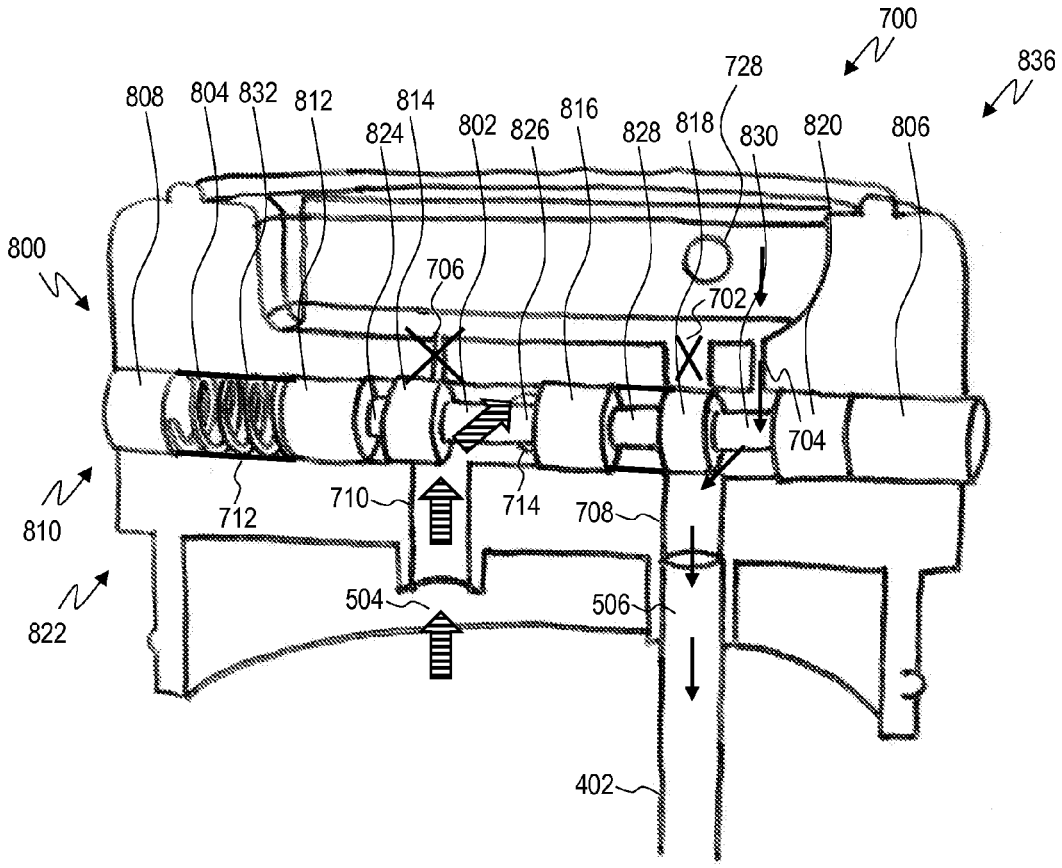
FIG. 11B is a cutaway view of the lid of FIG. 9A, with the valve assembly in a second valve position, along the cutaway line 11A, 11B of FIGS. 9A, 9B and 9C according to an exemplary embodiment of the invention.

The body 602 and the lid 700 may, at least in part, define a first fluid flow path 502 (shown in FIG. 11A) and a second fluid flow path 504 (shown in FIG. 11B). The first fluid flow path 502 may open to fluid flow of drinking fluid 606, from the body chamber 604 to the output end of one of the at least one drinking spouts 634, 642, 648, when the valve assembly 800 is in the first valve position 834, and the drinking device 600 is in the upright position. The second fluid flow path 504 may open to fluid flow of drinking fluid 606, from the body chamber 604 to the output end of one of the at least one drinking spouts 634, 642, 648, when the valve assembly 800 is in the second valve position 836, and the drinking device 600 is in the inverted position. The valve assembly 800 may include a first button 630, and a second button 632; which may be used to change from one valve position to another valve position.

The drinking device 600 may include an attachment device 612 with a first attachment device portion 614 which may be body spiral grooves 616, and a second attachment device portion 724 which may be lid spiral grooves 726. The drinking device 600 may include an open end 622 and a closed end 624. These elements and the body chamber 602 are similar to the first embodiment of the drinking device 100 and will not be further described.

Referring now to FIGS. 9A, 9B, 9C, 10, 11A, and 11B, two top perspective views, one bottom perspective view, a view of the valve assembly 800 housed inside, and two cut-away views of an exemplary lid 700 are illustrated. The lid 700 may include a first spout indentation 718 which may be located on the top of the lid 700. The first spout indentation 718 may include two first spout rotational indentations 728 (shown in FIGS. 11A and 11B).

Figure 9A:
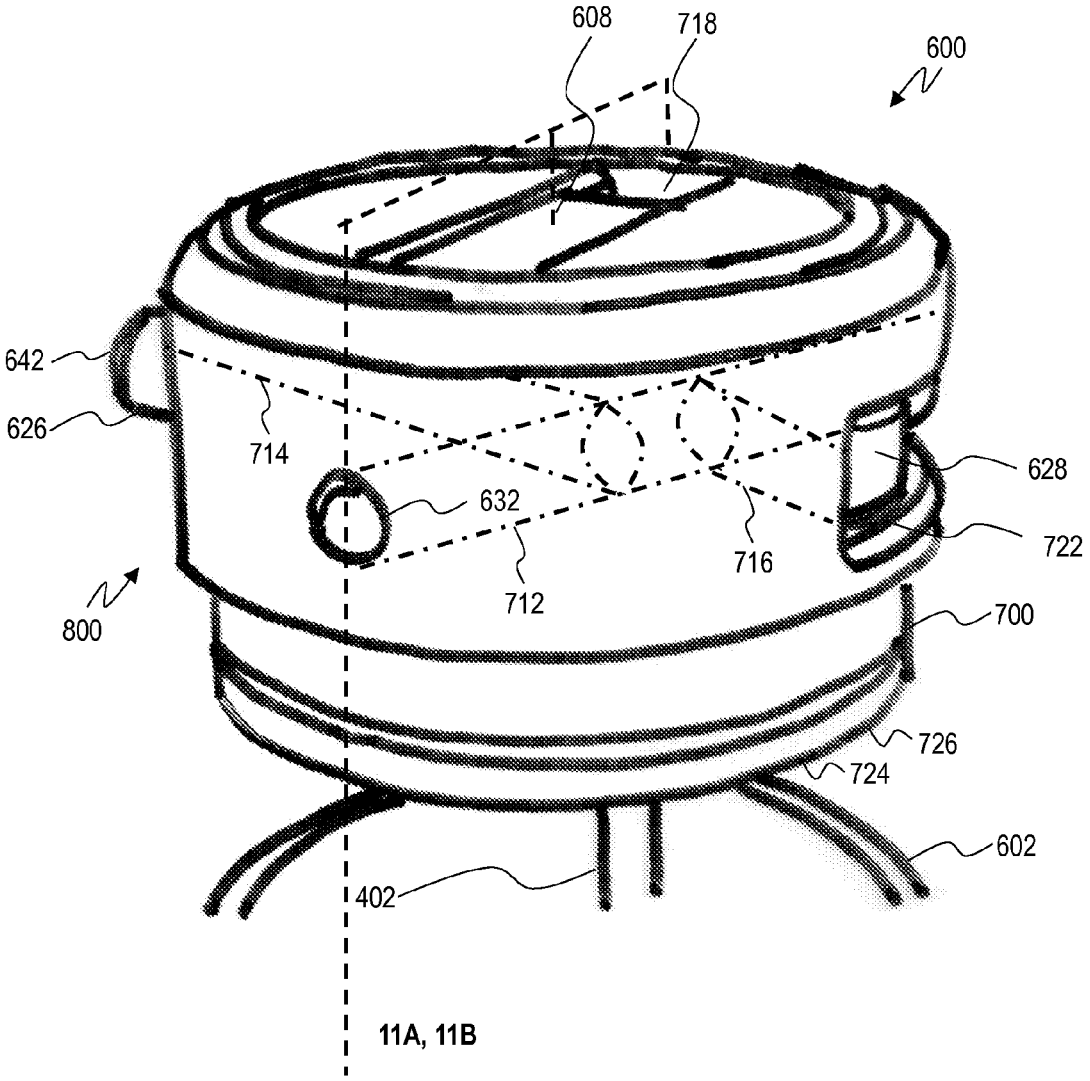
FIG. 9A is a top perspective view of a lid according to an exemplary embodiment of the invention.
Figure 9B:
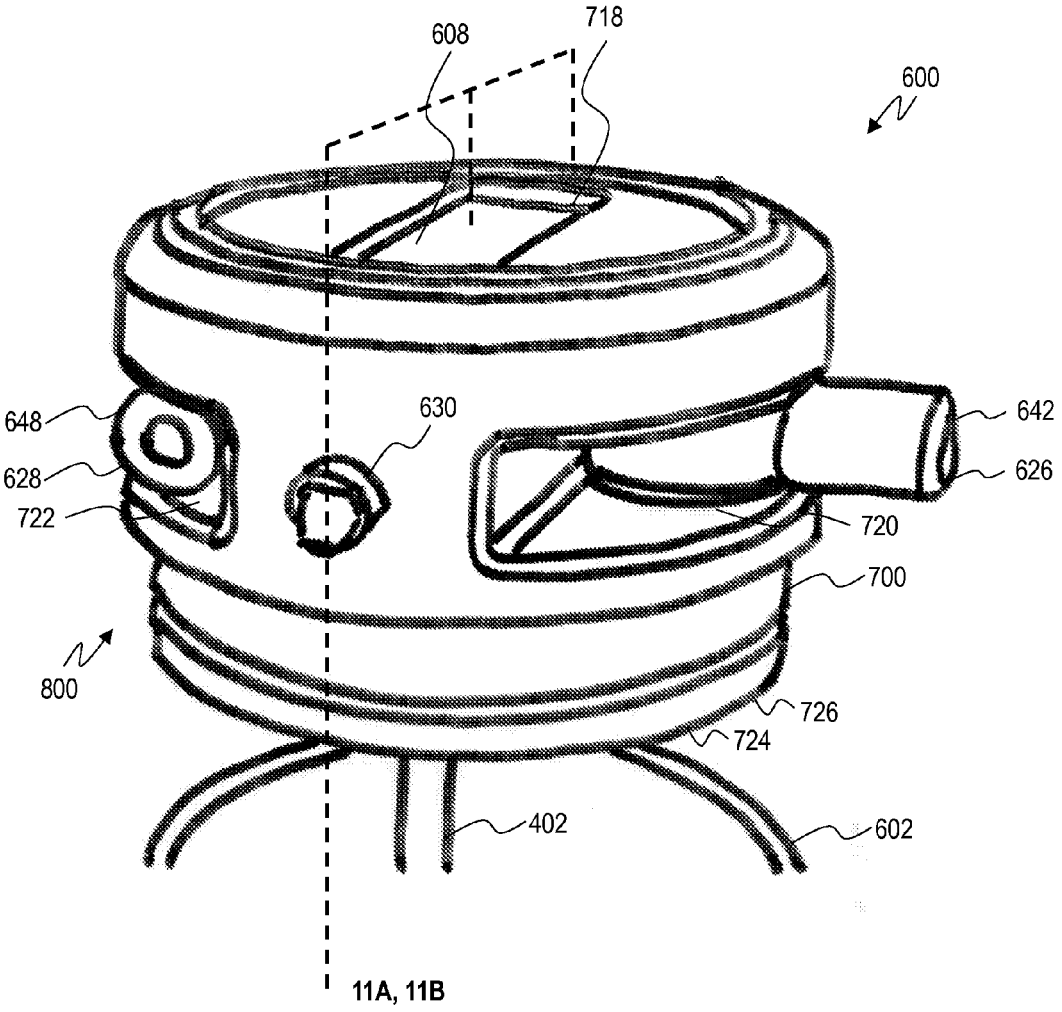
FIG. 9B is another top perspective view of the lid of FIG. 9A.
Figure 9C:
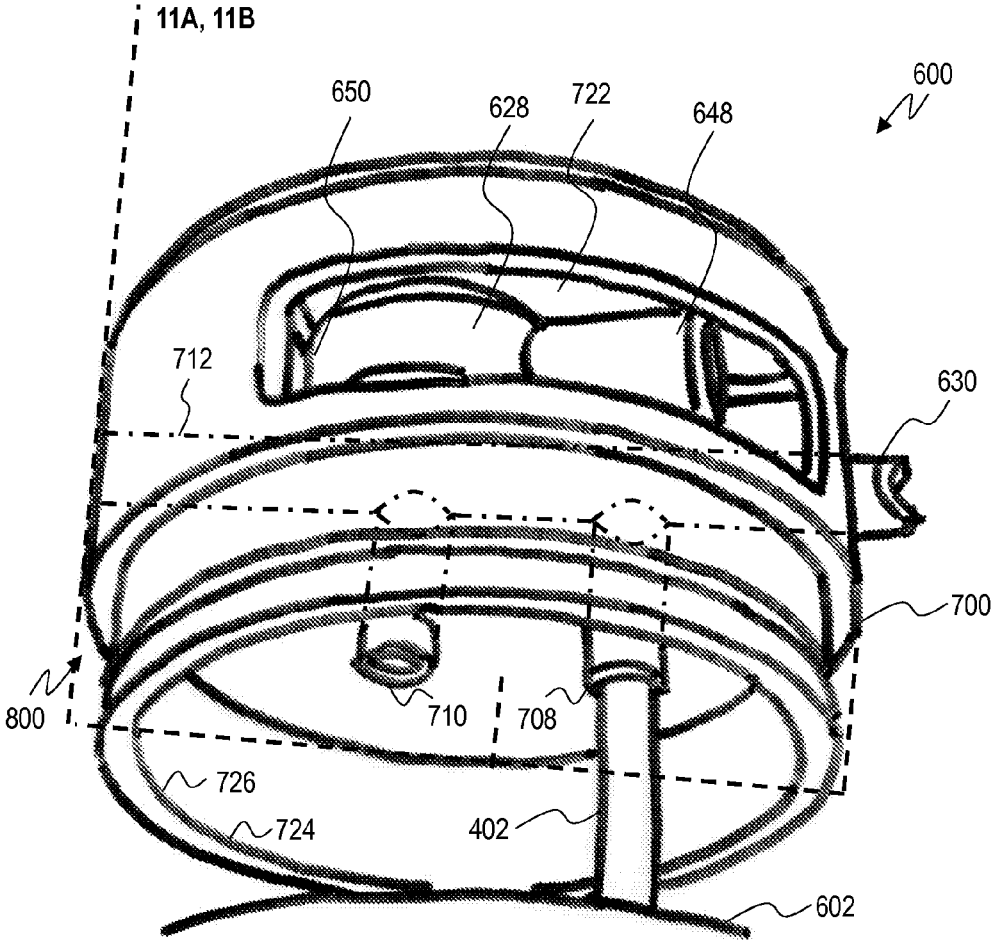
FIG. 9C is bottom perspective view of the lid of FIG. 9A.
Figure 10:
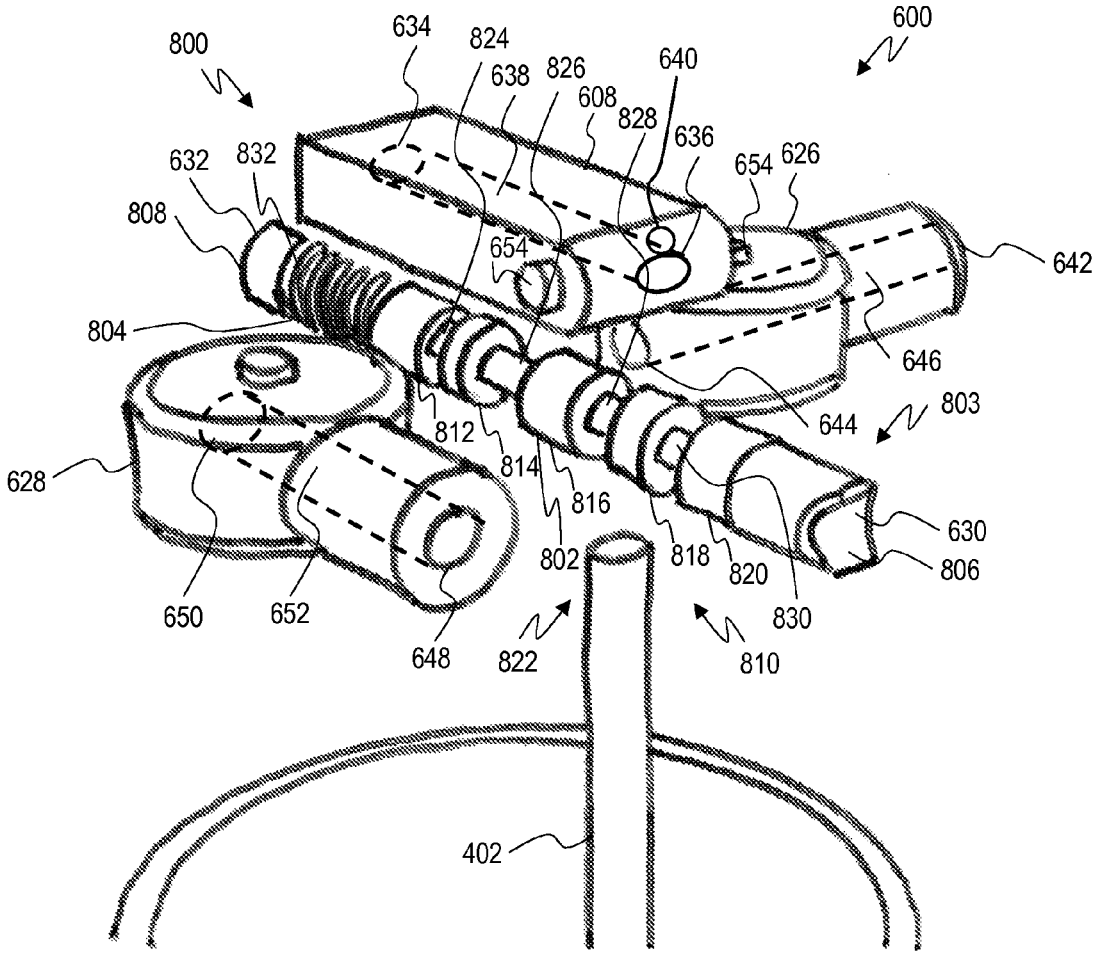
FIG. 10 is a perspective view of components housed in the interior of the lid of FIG. 9A according to an exemplary embodiment of the invention.

As shown in FIGS. 9A, 11A, and 11B, the lid 700 may include an upper conduit 702, a first upper vent 704, a second upper vent 706, a first lower fluid conduit 708, and a second lower fluid conduit 710. A horizontally elongated opening 712, may extend the general width of the lid 700 and is disposed between and separates the upper conduit 702 and first and second upper vents 704, 706 from the first and second lower fluid conduits 708, 710. The lid 700 may also include a first horizontal fluid conduit 714, and a second horizontal fluid conduit 716, each extending approximately half the width of the lid and each intersecting the horizontally elongated opening 712 at an approximately ninety (90) degree angle.

The first spout 608 may include two first spout rotational protrusions 654 (shown in FIG. 10) each of which may extend into one of the first spout rotational indentations 728 to pivotally couple the first spout 608 to the lid 700, and allow the first spout 608 to rotate approximately 90 degrees from a closed position, in which the first spout 608 is generally flush with a top surface of the lid 700, and an open position, in which the first spout 608 is rotated 90 degrees away from the top surface of the lid 700 and is oriented generally vertically. The first spout 608 may include a first spout fluid chamber 638 disposed between a first spout input end 636, and the first spout output end 634 such that a user may place their mouth over the first spout output end 634 and obtain fluid through the first spout input end 636. The first spout input end 636 may be selectively fluidly connected to the upper conduit 702 formed within the lid 700.

Based on the actuation of the valve assembly 800, which is discussed in more detail below, the upper conduit 702 may be in fluid communication with the first lower fluid conduit 708. The first lower fluid conduit 708 may be, in turn, in fluidic communication with the drinking fluid 606 held within the body chamber 604 of the drinking container. The first lower fluid conduit 708 may be fluidly connected to a straw 402 that extends towards the closed end 624 of the body 602. When the first spout 608 is closed, such that it is rotated downwards to lie generally flush with the top surface of the lid 700, the first spout input end 636 may not be in fluidic communication with the upper conduit 702, and fluid may not flow from the first spout 608.

To assist with the drawing of drinking fluid 606 through the first spout 608, the lid 700 may include the second upper vent 706, which may allow the release of air through the second upper vent 706 when the first spout 608 is in the raised, drinking position. The first spout 608 may include a nib 640 which may be pushed into a top of the second upper vent 706 when the first spout 608 is in the closed position to prevent drinking fluid 606 from escaping the second upper vent 706 when the drinking device 600 is in the inverted position.

The lid 700 may include a second spout indentation 720. The second spout 626 may be pivotally connected to the lid 700 to allow the second spout output end 642 to rotate in and out of the second spout indentation 720. The second spout 626 may rotate generally horizontally relative to the lid 700 to and from an open to a closed position. The second spout 626 may include a second spout fluid chamber 646 disposed between a second spout input end 644, and the second spout output end 642. When in the closed position, the second spout 626 may be rotated inwardly towards the lid 700.

When in the open position, the second spout 626 may be rotated outwardly, such that the user can place their mouth over the second spout output end 644. The second spout input end 644 may be fluidly connected to the first horizontal fluid conduit 708. Based on the actuation of the valve, the first horizontal fluid conduit 708 may be in fluid communication with the second lower fluid conduit 710. The second lower fluid conduit 710 may be in fluidic communication with the drinking fluid 606 held within the body chamber 604 of the drinking device 600. When the second spout 626 is closed, such that it is rotated inwardly into the lid, the second spout input end 636 may not be in fluidic communication with the first horizontal fluid conduit 714, and drinking fluid 606 may not be able to escape from the second spout 626.

The lid 700 may include a third spout indentation 722. The third spout 628 may be pivotally connected to the lid 700 to allow the third spout output end 648 to rotate in and out of the third spout indentation 722. The third spout 628 may include a third spout fluid chamber 652 disposed between a third spout input end 650, and the third spout output end 648. When in the closed position, the third spout 628 may be rotated inwardly towards the lid 700.

When in the open position, the third spout 628 may be rotated outwardly, such that the user can place their mouth over the third spout output end 648. The third spout input end 650 may be in fluidic communication with the second horizontal fluid conduit 716 formed within the lid 600. The second horizontal fluid conduit 716 may be in fluidic communication with the second lower fluid conduit 710 conduit, as described above for the second spout 626. The user may be able to select from which of the second and third spouts 626, 628 the user desires to drink when the drinking device 600 is in the inverted position.

The valve assembly 800 may include a spool valve 802 which may be housed within the lid 700. In alternative embodiments, the spool valve 802 may be spaced from the lid 700 and fluidly connected thereto. The spool valve 802 may include a generally horizontally oriented spool 803 having a generally cylindrical body for being held within the horizontally elongated opening 712, a selectively actuated release mechanism 804 also held within the horizontally elongated opening 712 for actuating the spool 803 horizontally within the opening, a first actuator 806 held at one end of the horizontally elongated opening 812 and extending outwards from an external surface of the lid 700 (which may include the first button 630), and a second actuator 808 held at the other end of the horizontally elongated opening 712 (which may include the second button 632). The release mechanism 804 may be disposed between the second actuator 804 and an end of the spool 803. The release mechanism 804 may be a spring 832, or in other embodiments may be rubber band, O-ring, or other suitable mechanism for holding the spool 803 in position upon actuation of the valve assembly 800 by the user.

The spool 803 may include a series of radially wide segments 810 which may prevent passage of the drinking fluid 606 and air through the horizontally elongated opening 712. The radially wide segments 810 may include a first radially wide segment 812, a second radially wide segment 814, a third radially wide segment 816, a fourth radially wide segment 818, and a fifth radially wide segment 820. Portions of the radially wide segments 810 may include a radially extending gasket or other seal (not shown) surrounding the portion of the segment to prevent even minimal passage of the drinking fluid 606 and air through the horizontally elongated opening 712.

The spool 803 may also include a series of radially narrow fluid passages 822 which may allow passage of the drinking fluid 606 and air through the horizontally elongated opening 712. The radially narrow fluid passaged 822 may include a first radially narrow fluid passage 824, a second radially narrow fluid passage 826, a third radially narrow fluid passage 828, and a fourth radially narrow fluid passage 830.

The spool 803 may move horizontally within the horizontally elongated opening 712 to obtain alignment of one of the radially narrow fluid passages 822 with a fluid conduit 702, 714, 716 in communication with the spout 608, 626, 628 selected by the user. The spool 803 may fit snugly within the horizontally elongated opening 712, but not so tightly that the spool 803 cannot be moved horizontally upon actuation of force from a user's thumb or finger. Due to this, there may be a slight clearance between the radially wide segments 810 and the internal surface of the horizontally elongated opening 712. Gaskets or other seals may prevent passage of the drinking fluid 606 and air through this clearance. Upon the user pressing the first actuator 806, the spool 803 may move horizontally towards the second actuator 808. Upon the user pressing the second actuator 808, the spool 803 may move horizontally in the opposite direction and towards the first actuator 806.

To drinking from the drinking device 600 when the drinking device is upright, the valve assembly 800 may be in the first valve position 834. When the valve assembly 800 is in the first valve position, the spool 803 may be in a default position, which the release mechanism 712 returns the spool 803 to when the first actuator 806 is not pressed. In addition, the user may pivot the first spout 608 into the open position. The user may then be able to provide suction to drink from drinking fluid 606 from the body chamber 604. In the first valve position 834, the third radially narrow fluid passage 828 may be aligned with the upper conduit 702 and the first lower conduit 708, and may allow passage of the drinking fluid 606 to pass through. The drinking fluid 606 may follow a first fluid flow path 502, represented by the outlined arrows with no fill. The drinking fluid 606 may flow from the body chamber 604, through the straw 402, through the first lower fluid conduit 708, through the third radially narrow fluid passage 828, through the upper conduit 702, through the first spout input end 636, through the first spout fluid chamber 638, and through the first spout output end 634.

Additionally, with the first spout 608 in the open position, the second upper vent 706 may be open to allow air to flow through to replace drinking fluid 606 which the user consumes. The air follow an air flow path 506 represented by the single line arrows. The air may flow through the second upper vent 706, through the first radially narrow fluid passage 824, through the second lower fluid conduit, and into the body chamber 604.

To drink from the drinking device 600 when the drinking device 600 is inverted, the user may actuate the valve assembly 800 into a second valve position 836. When the valve assembly 800 is in the second valve position 836, the spool 803 may be displaced towards the second actuator 808, and one of the second spout 626 or the third spout 628 may be rotated outwardly from the lid 700. Upon the spool 803 being displaced towards the second actuator 808, the second radially narrow fluid passage 826 may fluidly align with the second lower conduit 710 for passage of the drinking fluid 606 through either of the second or third spouts 626, 628 when drinking from an inverted position. The user may rotate one of the second spout 626 or the third spout 628 outwardly. The user may then access drinking fluid 606 via the outwardly rotated spout. The drinking fluid 606 may follow a second fluid flow path 504 as represented by the striped arrows.

Air following the air flow path 506, as represented by the single line arrows may replace the drinking fluid the user drinks. When the valve assembly is in the second valve position 836, air may flow through the first upper vent 704, through the fourth radially narrow fluid passage 830, through the first lower fluid conduit 708, and through the straw 402 into the body chamber 604.

Drinking fluid 606 may not be able to escape from the other, inwardly rotated spout 626, 628, because the second spout output end 644, or the third spout output end 652 may not be aligned with the first horizontal fluid conduit 714, or the second horizontal fluid conduit 716, respectively. In addition, drinking fluid 606 may not be able to escape along the horizontally elongated opening 712 in the lid because the second and third radially wide segments 824, 826 may block passage of the drinking fluid 606 along the horizontally elongated opening 712. Drinking fluid 606 is blocked from entering the first spout 608 through the upper conduit 702, from the first lower fluid conduit 708, by the fourth radially wide segment 818.

Figure 12:
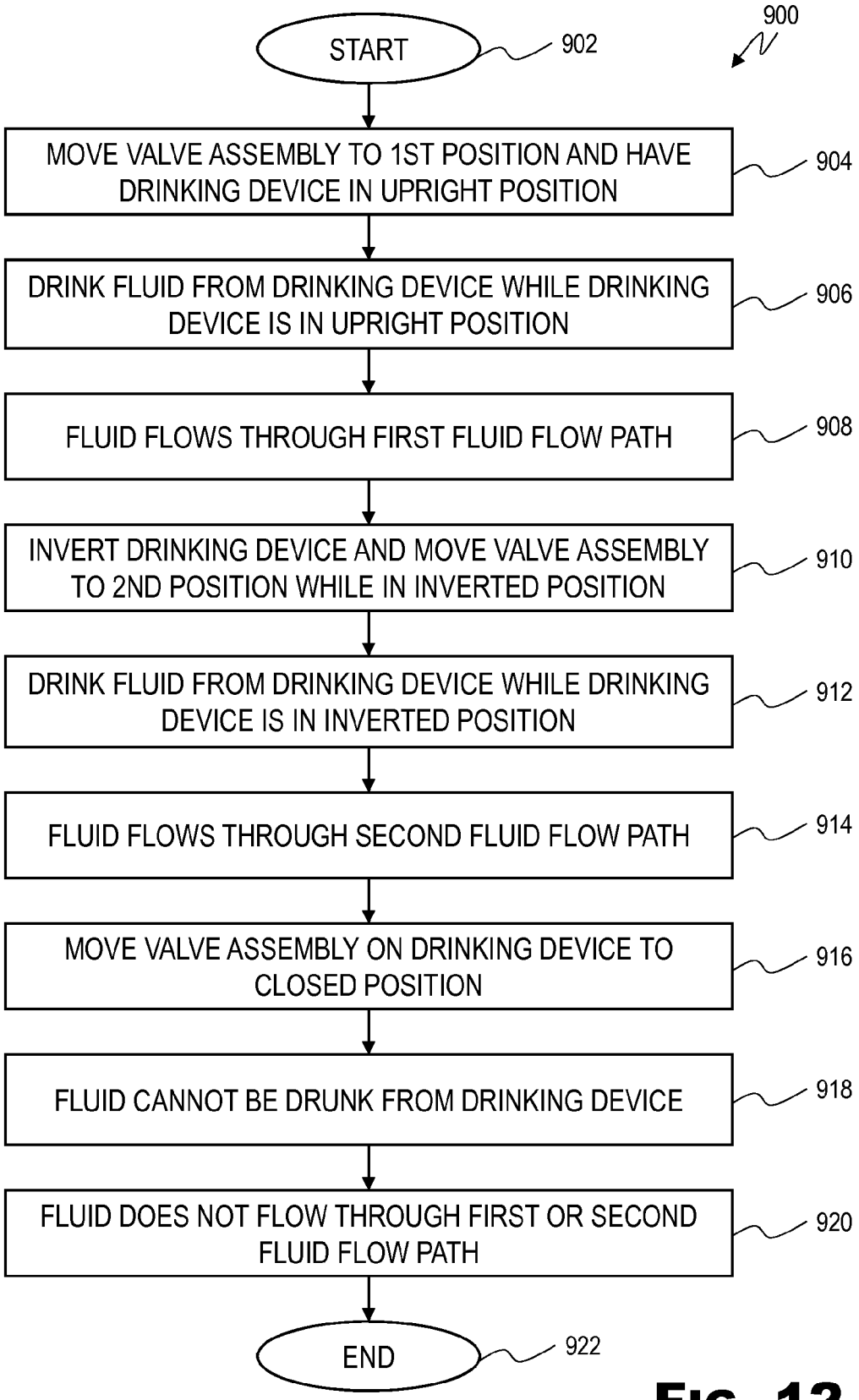
FIG. 12 is a flow chart of a method of drinking from an invertible drinking device according to an exemplary embodiment of the invention.

Referring now to FIG. 12, a method 900 of drinking from an invertible drinking device 100 is illustrated in a flow chart. Although the method 900 may be described in relation to the embodiment of FIGS. 1-7, one skilled in the art will realize that it may also be performed with the drinking device 600 embodiment 300 to a first valve position of FIGS. 8-11. The method 900 starts at 902. A user may move a valve assembly 300 into a first valve position 382, while the drinking device 100 is in an upright position (step 904). The user may move the drinking spout 108 from a closed position to an upright open position by rotating the drinking spout 108 away from the lid 200. The inverted fluid path closing edge 344 of the valve sliding member 302 may squeeze the inverted input portion 406 of the tube assembly 404 closed, while the upright input portion 408 of the tube assembly 404 may remain open. While the drinking spout 108 was in the closed position, the main portion 410 of the tube assembly 404 may have been squeezed closed by the spout housing 348. When the drinking spout 108 is moved to the open position, the main portion 410 may be opened.

The user may then drink drinking fluid 106 from the drinking device 100 by applying suction to the nozzle 412 (step 906). Drinking fluid 106 may flow through a first fluid flow path 502 from the body chamber 104 to the nozzle 412 (step 908). The drinking fluid 106 may flow through the straw 402, through the upright fluid input 294, through the upright input portion 408, through the main portion 410, and through the nozzle 412 to the user.

If the user desires to drink from the drinking device 100 with the drinking device 100 in the inverted position the user may invert the drinking device 100 and move the valve assembly 300 to the second valve position 384 (step 910). The user may desire to drink from the drinking device 100 in an inverted position when the user is lying down, for example. The user may move the valve assembly 300 to the second valve position 384 by rotating the drinking spout 108 outward from the lid 200 to the inverted position where the drinking spout 108 may be at approximately a one hundred and eighty (180) degree angle with the top 206 of the lid 200. When rotating the drinking spout 108 to the inverted position, the first and second inverted protrusions 378, 380 of the spout housing 348, may push on the first and second inverted protrusions 336, 338 of the valve sliding member 302, such that the valve sliding member 302 may slide across the top wall 266 of the lid bottom portion 204, and the upright fluid path closing edge 342 may squeeze the upright input portion 408 of the tube assembly closed; and the inverted fluid path closing edge 344 may move such that the inverted input portion 406 of the tube assembly is open.

The user may then drink from the drinking device 100 by applying suction to the nozzle 412 (step 912). Drinking fluid 106 may flow through a second fluid flow path 504 from the body chamber 104 to the nozzle 412 (step 914). The drinking fluid 106 may flow through the inverted fluid input 296, through the inverted input portion 406, through the main portion 410, and through the nozzle 412 to the user.

If the user desires not to drink from the drinking device 100, and wishes that drinking fluid 106 not flow through either of the first fluid flow path 504, or the second fluid flow path 506, the user may move the valve assembly 300 to the third valve position 386, which is a closed position (step 916). The main portion 410 of the tube assembly may be stretch and squeezed closed against the drinking tube channel 362 at the spout housing input end 358. Drinking fluid 106 may then not flow from the body chamber 104 to the nozzle 412, and the user may not be able to drink the drinking fluid 106 from the drinking device 100 (steps 918, 920). The method 900 ends at step 922.

It should be understood, of course, that the foregoing relates to exemplary embodiments of the invention and that modifications may be made without departing from the spirit and scope of the invention as set forth in the following claims.

We claim:

1. An invertible drinking device moveable between an upright position and an inverted position, comprising:

a body including a fluid chamber;

a lid removeably attachable to the body;

a tube assembly with an inverted input portion, an upright input portion, a main portion, and a nozzle;

a drinking spout including an output end, a spout housing and the nozzle, the drinking spout moveable between an upright spout open position and an inverted spout open position; and a valve assembly including the spout housing, and a valve sliding member having an upright fluid path closing edge, and an inverted fluid path closing edge; the valve sliding member moveable between a first sliding member position wherein the inverted fluid path closing edge squeezes the inverted input portion closed, and a second sliding member position wherein the upright fluid path closing edge squeezes the upright input portion closed; and wherein the body and the lid, at least in part, define a first fluid flow path; the first fluid flow path open to fluid flow, from the fluid chamber to the output end of the drinking spout, when the drinking spout is in the upright spout open position, the valve sliding member is in the first sliding member position, and the drinking device is in the upright position;

wherein the body and the lid, at least in part, define a second fluid flow path; the second fluid flow path open to fluid flow, from the fluid chamber to the output end of the drinking spout, when the drinking spout is in the inverted spout open position, the valve sliding member is in the second sliding member position, and the drinking device is in the inverted position.

2. The drinking device of claim 1, wherein:

the main portion of the tube assembly fluidly connects the output end of the drinking spout with the upright input portion and the inverted input portion; and the drinking spout is moveable to a closing position wherein the spout housing squeezes the main portion closed, fluidly disconnecting the output end of the spout from the inverted input portion and the upright input portion.

3. The drinking device of claim 2, wherein:

the lid includes a spout channel; and the drinking spout lies within the spout channel when the drinking spout is in the closing position.

4. The drinking device of claim 1, wherein:

the lid includes a top lid portion and a bottom lid portion;

the valve sliding member is sandwiched between the top lid portion and the bottom lid portion.

5. The drinking device of claim 1, wherein:

the lid includes a spout channel having a rotation indentation;

the spout housing includes a rotation protrusion extending into the rotation indentation and pivotally connecting the spout housing to the lid.

6. The drinking device of claim 1, wherein:

the lid includes a spout channel with a first side wall and a second side wall;

the valve sliding member includes a first protrusion with a first guide surface and a second protrusion with a second guide surface; and the first guide surface abuts the first side wall and the second guide surface abuts the second side wall.

7. The drinking device of claim 1, wherein:

the lid includes a top lid portion and a bottom lid portion with a first valve guide and a second valve guide;

the valve sliding member includes a first guiding edge and a second guiding edge, and is sandwiched between the top lid portion and the bottom lid portion; and the first guiding edge abuts the first valve guide and the second guiding edge abuts the second valve guide.

8. An invertible drinking device, comprising:

a body including a fluid chamber;

a lid removeably attachable to the body, and including an upright fluid input fluidly connected to the fluid chamber, an inverted fluid input fluidly connected to the fluid chamber, and a spout channel with a first side wall and a second side wall;

a drinking spout including a spout housing and an spout output end for drinking fluid;

a valve assembly including the spout housing and a sliding valve member, the sliding valve member including an upright fluid path closing edge, an inverted fluid path closing edge, a first protrusion with a first guide surface, and a second protrusion with a second guide surface; and tubing including an upright input portion selectively and fluidly connecting the spout output end and the upright fluid input; and an inverted input portion selectively and fluidly connecting the spout output end and the inverted fluid input; and wherein the first guide surface abuts the first side wall, and the second guide surface abuts the second side wall wherein the valve assembly is moveable to a first position wherein the inverted fluid path closing edge blocks the inverted tubing input portion, fluidly disconnecting the spout output end and the inverted fluid input; and wherein the valve assembly is moveable to a second position wherein the upright fluid path closing edge blocks the upright tubing input portion, fluidly disconnecting the spout output end and the upright fluid input.

9. The drinking device of claim 8, wherein:

the tubing assembly further includes a main portion fluidly connecting the spout output end with the upright input portion and the inverted input portion; and the valve assembly is moveable to a third position wherein the spout housing squeezes the main portion closed, fluidly disconnecting the spout output end from the inverted input portion and the upright input portion.

10. The drinking device of claim 9, wherein:

the drinking spout lies within the spout channel when the valve assembly is in the third position.

11. The drinking device of claim 8, further including a straw fluidly connecting the fluid chamber with the upright fluid input.

12. The drinking device of claim 8, wherein:

the lid includes a top lid portion and a bottom lid portion;

the valve sliding member is sandwiched between the top lid portion and the bottom lid portion.

13. The drinking device of claim 8, wherein:

the spout channel includes a rotation indentation;

the spout housing includes a rotation protrusion extending into the rotation indentation and pivotally connecting the spout housing to the lid.

14. The drinking device of claim 8, wherein:

the lid includes a top lid portion and a bottom lid portion with a first valve guide and a second valve guide;

the valve sliding member includes a first guiding edge and a second guiding edge, and is sandwiched between the top lid portion and the bottom lid portion; and the first guiding edge abuts the first valve guide and the second guiding edge abuts the second valve guide.

15. An invertible drinking device, comprising:

a body including a fluid chamber;

a lid removeably attachable to the body, and including an upright fluid input fluidly connected to the fluid chamber, an inverted fluid input fluidly connected to the fluid chamber, a top lid portion, and a bottom lid portion with a first valve guide and a second valve guide;

a drinking spout including a spout housing and an spout output end for drinking fluid;

a valve assembly including the spout housing and a sliding valve member, the sliding valve member including an upright fluid path closing edge, an inverted fluid path closing edge, a first guiding edge, and a second guiding edge, the sliding valve member sandwiched between the top lid portion and the bottom lid portion; and tubing including an upright input portion selectively and fluidly connecting the spout output end and the upright fluid input; and an inverted input portion selectively and fluidly connecting the spout output end and the inverted fluid input; and wherein the first guiding edge abuts the first valve guide, and the second guiding edge abuts the second valve guide;

wherein the valve assembly is moveable to a first position wherein the inverted fluid path closing edge blocks the inverted tubing input portion, fluidly disconnecting the spout output end and the inverted fluid input; and wherein the valve assembly is moveable to a second position wherein the upright fluid path closing edge blocks the upright tubing input portion, fluidly disconnecting the spout output end and the upright fluid input.

16. The drinking device of claim 15, wherein:

the tubing assembly further includes a main portion fluidly connecting the spout output end with the upright input portion and the inverted input portion; and the valve assembly is moveable to a third position wherein the spout housing squeezes the main portion closed, fluidly disconnecting the spout output end from the inverted input portion and the upright input portion.

17. The drinking device of claim 16, wherein:

the lid includes a spout channel; and the drinking spout lies within the spout channel when the valve assembly is in the third position.

18. The drinking device of claim 15, further including a straw fluidly connecting the fluid chamber with the upright fluid input.

19. The drinking device of claim 15, wherein:

the lid includes a spout channel having a rotation indentation;

the spout housing includes a rotation protrusion extending into the rotation indentation and pivotally connecting the spout housing to the lid.

20. The drinking device of claim 15, wherein:

the lid includes a spout channel with a first side wall and a second side wall;

the valve sliding member includes a first protrusion with a first guide surface and a second protrusion with a second guide surface; and the first guide surface abuts the first side wall and the second guide surface abuts the second side wall.

* * * * *